US009221279B2

(12) United States Patent
Houjou

(10) Patent No.: US 9,221,279 B2
(45) Date of Patent: Dec. 29, 2015

(54) IMAGE RECORDING APPARATUS AND METHOD, AND VARNISH APPLICATION DEVICE AND METHOD

(71) Applicant: FUJIFILM Corporation, Tokyo (JP)

(72) Inventor: Hiroaki Houjou, Ashigarakami-gun (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 14/635,497

(22) Filed: Mar. 2, 2015

(65) Prior Publication Data

US 2015/0246556 A1 Sep. 3, 2015

(30) Foreign Application Priority Data

Mar. 3, 2014 (JP) ..... 2014-040486

(51) Int. Cl.

| | |
|---|---|
| ***B41J 29/38*** | (2006.01) |
| ***B41J 11/00*** | (2006.01) |
| *G01D 11/00* | (2006.01) |
| *B41J 2/175* | (2006.01) |

(52) U.S. Cl.

CPC ..... *B41J 11/002* (2013.01); *B41J 2/17593* (2013.01); *B41J 11/0015* (2013.01)

(58) Field of Classification Search

CPC .... B41J 11/002; B41J 11/0015; B41J 2/2114; B41M 5/0011; B41M 7/00; B41L 23/24

See application file for complete search history.

(56) References Cited

U.S. PATENT DOCUMENTS

| | | | | |
|---|---|---|---|---|
| 2009/0086000 | A1 * | 4/2009 | Yokota | 347/102 |
| 2010/0194837 | A1 | 8/2010 | Ohshima et al. | |
| 2013/0083117 | A1 | 4/2013 | Ohmoto | |
| 2013/0088556 | A1 * | 4/2013 | Hagspiel | 347/110 |

FOREIGN PATENT DOCUMENTS

| | | | |
|---|---|---|---|
| JP | 2010-173286 | A | 8/2010 |
| JP | 2013-082209 | A | 5/2013 |

* cited by examiner

*Primary Examiner* — Shelby Fidler
*Assistant Examiner* — Tracey McMillion
(74) *Attorney, Agent, or Firm* — Studebaker & Brackett PC

(57) ABSTRACT

The present invention provides an image recording apparatus and method, and a varnish application device and method, which can ensure the adhesiveness of the varnish that has been applied onto the surface of the image. An image recording method according to an aspect of the present invention includes: comparing an attained temperature T1 (attained temperature T1 when ink has been dried) of the surface of the image on the medium when the ink has been dried, with a melting point TW of the wax component contained in the ink; and heating the surface of the image before the varnish that has been applied in the varnish application step is cured in the varnish curing step, when T1≥TW holds.

14 Claims, 17 Drawing Sheets

FIG.7

Table 1 Basic test result

| | | attained temperature [°C] in heating before varnish is cured | | | | | | | | |
|---|---|---|---|---|---|---|---|---|---|---|
| | | 25~34 | 35~39 | 40~44 | 45~54 | 55~64 | 65~74 | 75~83 | 84~89 | 90~99 |
| attained temperature [°C] when ink has been dried | 40 | 4 | — | 4 | 4 | 4 | 4 | 4 | 4 | 4 |
| | 50 | 4 | — | 4 | 4 | 4 | 4 | 4 | 4 | 4 |
| | 60 | — | 4 | — | 4 | 4 | 4 | 4 | 4 | 4 |
| | 70 | — | 4 | — | 4 | 4 | 4 | 4 | 4 | 4 |
| | 80 | — | 3 | — | 4 | 4 | 4 | 4 | 4 | 4 |
| | 85 | — | — | 2 | — | 3 | 3 | 3 | 4 | 4 |
| | 90 | — | — | 2 | — | 3 | 3 | 3 | 4 | 4 |
| | 100 | — | — | — | 1 | 3 | 3 | 3 | 4 | 4 |

FIG.8A

Table 2-1 Test results of adhesive performance depending on difference among melting points of wax (1): in-line varnish coating · melting point of wax: 83 [°C]

| | | attained temperature [°C] in heating before varnish is cured | | | | | | | | |
|---|---|---|---|---|---|---|---|---|---|---|
| | | 25~34 | 35~39 | 40~44 | 45~54 | 55~64 | 65~74 | 75~83 | 84~89 | 90~99 |
| attained temperature [°C] when ink has been dried | 40 | 4 | — | 4 | 4 | 4 | 4 | 4 | 4 | 4 |
| | 50 | 4 | — | 4 | 4 | 4 | 4 | 4 | 4 | 4 |
| | 60 | — | 4 | — | 4 | 4 | 4 | 4 | 4 | 4 |
| | 70 | — | 4 | — | 4 | 4 | 4 | 4 | 4 | 4 |
| | 80 | — | 3 | — | 4 | 4 | 4 | 4 | 4 | 4 |
| | 85 | — | — | 2 | — | 3 | 3 | 3 | 4 | 4 |
| | 90 | — | — | 2 | — | 3 | 3 | 3 | 4 | 4 |
| | 100 | — | — | — | 1 | 3 | 3 | 3 | 4 | 4 |

FIG.8B

Table 2-2 Test results of adhesive performance depending on difference among melting points of wax (2): in-line varnish coating · melting point of wax: 55 [°C]

| | | attained temperature [°C] in heating before varnish is cured | | | | | | | | |
|---|---|---|---|---|---|---|---|---|---|---|
| | | 25~34 | 35~39 | 40~44 | 45~54 | 55~64 | 65~74 | 75~83 | 84~89 | 90~99 |
| attained temperature [°C] when ink has been dried | 40 | 4 | — | 4 | 4 | 4 | 4 | 4 | 4 | 4 |
| | 50 | 4 | — | 4 | 4 | 4 | 4 | 4 | 4 | 4 |
| | 60 | — | 2 | — | 3 | 4 | 4 | 4 | 4 | 4 |
| | 70 | — | 1 | — | 3 | 4 | 4 | 4 | 4 | 4 |
| | 80 | — | 1 | — | 3 | 4 | 4 | 4 | 4 | 4 |
| | 85 | — | — | 1 | — | 4 | 4 | 4 | 4 | 4 |
| | 90 | — | — | 1 | — | 4 | 4 | 4 | 4 | 4 |
| | 100 | — | — | — | 1 | 4 | 4 | 4 | 4 | 4 |

FIG.8C

Table 2-3 Test results of adhesive performance depending on difference of melting points of wax (3): in-line varnish coating · melting point of wax: 102 [°C]

| | | attained temperature [°C] in heating before varnish is cured | | | | | | | | |
|---|---|---|---|---|---|---|---|---|---|---|
| | | 25~34 | 35~39 | 40~44 | 45~54 | 55~64 | 65~74 | 75~83 | 84~89 | 90~99 |
| attained temperature [°C] when ink has been dried | 40 | 4 | — | 4 | 4 | 4 | 4 | 4 | 4 | 4 |
| | 50 | 4 | — | 4 | 4 | 4 | 4 | 4 | 4 | 4 |
| | 60 | — | 4 | — | 4 | 4 | 4 | 4 | 4 | 4 |
| | 70 | — | 4 | — | 4 | 4 | 4 | 4 | 4 | 4 |
| | 80 | — | 4 | — | 4 | 4 | 4 | 4 | 4 | 4 |
| | 85 | — | — | 4 | — | 4 | 4 | 4 | 4 | 4 |
| | 90 | — | — | 4 | — | 4 | 4 | 4 | 4 | 4 |
| | 100 | — | — | — | 3 | 4 | 4 | 4 | 4 | 4 |

FIG.9A

Table 3-1 Test results of adhesive performance depending on difference of melting points of wax (1): off-line varnish coating
*melting point of wax: 83 [°C]

| | | attained temperature [°C] in heating before varnish is cured | | | | | | | | |
|---|---|---|---|---|---|---|---|---|---|---|
| | | 25~34 | | | 45~54 | 55~64 | 65~74 | 75~83 | 84~89 | 90~99 |
| attained temperature [°C] when ink has been dried | 40 | 4 | | | 4 | 4 | 4 | 4 | 4 | 4 |
| | 50 | 4 | | | 4 | 4 | 4 | 4 | 4 | 4 |
| | 60 | 4 | | | 4 | 4 | 4 | 4 | 4 | 4 |
| | 70 | 4 | | | 4 | 4 | 4 | 4 | 4 | 4 |
| | 80 | 3 | | | 4 | 4 | 4 | 4 | 4 | 4 |
| | 85 | 2 | | | 3 | 3 | 3 | 3 | 4 | 4 |
| | 90 | 1 | | | 3 | 3 | 3 | 3 | 4 | 4 |
| | 100 | 1 | | | 3 | 3 | 3 | 3 | 4 | 4 |

FIG.9B

Table 3-2 Test results of adhesive performance depending on difference of melting points of wax (2): off-line varnish coating
*melting point of wax: 55 [°C]

| | | attained temperature [°C] in heating before varnish is cured | | | | | | | | |
|---|---|---|---|---|---|---|---|---|---|---|
| | | 25~34 | | | 45~54 | 55~64 | 65~74 | 75~83 | 84~89 | 90~99 |
| attained temperature [°C] when ink has been dried | 40 | 4 | | | 4 | 4 | 4 | 4 | 4 | 4 |
| | 50 | 4 | | | 4 | 4 | 4 | 4 | 4 | 4 |
| | 60 | 2 | | | 3 | 4 | 4 | 4 | 4 | 4 |
| | 70 | 1 | | | 3 | 4 | 4 | 4 | 4 | 4 |
| | 80 | 1 | | | 3 | 4 | 4 | 4 | 4 | 4 |
| | 85 | 1 | | | 3 | 4 | 4 | 4 | 4 | 4 |
| | 90 | 1 | | | 3 | 4 | 4 | 4 | 4 | 4 |
| | 100 | 1 | | | 3 | 4 | 4 | 4 | 4 | 4 |

FIG.9C

Table 3-3 Test results of adhesive performance depending on difference of melting points of wax (3): off-line varnish coating
*melting point of wax: 100 [°C]

| | | attained temperature [°C] in heating before varnish is cured | | | | | | | | |
|---|---|---|---|---|---|---|---|---|---|---|
| | | 25~34 | | | 45~54 | 55~64 | 65~74 | 75~83 | 84~89 | 90~99 |
| attained temperature [°C] when ink has been dried | 40 | 4 | | | 4 | 4 | 4 | 4 | 4 | 4 |
| | 50 | 4 | | | 4 | 4 | 4 | 4 | 4 | 4 |
| | 60 | 4 | | | 4 | 4 | 4 | 4 | 4 | 4 |
| | 70 | 4 | | | 4 | 4 | 4 | 4 | 4 | 4 |
| | 80 | 4 | | | 4 | 4 | 4 | 4 | 4 | 4 |
| | 85 | 4 | | | 4 | 4 | 4 | 4 | 4 | 4 |
| | 90 | 4 | | | 4 | 4 | 4 | 4 | 4 | 4 |
| | 100 | 3 | | | 4 | 4 | 4 | 4 | 4 | 4 |

FIG.10A

Table 4-1 Test results of adhesive performance depending on difference of paper type and paper thickness (1)
*paper: Eye best W 310 gsm (made by Nippon Paper Industries Co., Ltd., and paper thickness: 0.34 [mm])

| | | attained temperature [°C] in heating before varnish is cured | | | | | | | | |
|---|---|---|---|---|---|---|---|---|---|---|
| | | 25~34 | 35~39 | 40~44 | 45~54 | 55~64 | 65~74 | 75~83 | 84~89 | 90~99 |
| attained temperature [°C] when ink has been dried | 40 | 4 | — | 4 | 4 | 4 | 4 | 4 | 4 | 4 |
| | 50 | 4 | — | 4 | 4 | 4 | 4 | 4 | 4 | 4 |
| | 60 | — | 4 | — | 4 | 4 | 4 | 4 | 4 | 4 |
| | 70 | — | 4 | — | 4 | 4 | 4 | 4 | 4 | 4 |
| | 80 | — | 3 | — | 4 | 4 | 4 | 4 | 4 | 4 |
| | 85 | — | — | 2 | — | 3 | 3 | 3 | 4 | 4 |
| | 90 | — | — | 2 | — | 3 | 3 | 3 | 4 | 4 |
| | 100 | — | — | — | 1 | 3 | 3 | 3 | 4 | 4 |

FIG.10B

Table 4-2 Test results of adhesive performance depending on difference of paper type and paper thickness (2)
*paper: NEW DV 310 gsm (made by Hokuetsu Kishu Paper Co., Ltd., and paper thickness: 0.38 [mm])

| | | attained temperature [°C] in heating before varnish is cured | | | | | | | | |
|---|---|---|---|---|---|---|---|---|---|---|
| | | 25~34 | 35~39 | 40~44 | 45~54 | 55~64 | 65~74 | 75~83 | 84~89 | 90~99 |
| attained temperature [°C] when ink has been dried | 40 | 4 | — | 4 | 4 | 4 | 4 | 4 | 4 | 4 |
| | 50 | 4 | — | 4 | 4 | 4 | 4 | 4 | 4 | 4 |
| | 60 | — | 4 | — | 4 | 4 | 4 | 4 | 4 | 4 |
| | 70 | — | 4 | — | 4 | 4 | 4 | 4 | 4 | 4 |
| | 80 | — | 3 | — | 4 | 4 | 4 | 4 | 4 | 4 |
| | 85 | — | — | 2 | — | 4 | 4 | 4 | 4 | 4 |
| | 90 | — | — | 2 | — | 3 | 4 | 4 | 4 | 4 |
| | 100 | — | — | — | 2 | 3 | 4 | 4 | 4 | 4 |

FIG.10C

Table 4-3 Test results of adhesive performance depending on difference of paper type and paper thickness (3)
*paper: MARIKOTE (basis weight: 310 [gsm], made by Hokuetsu Kishu Paper Co., Ltd., and paper thickness: 0.38 [mm])

| | | attained temperature [°C] in heating before varnish is cured | | | | | | | | |
|---|---|---|---|---|---|---|---|---|---|---|
| | | 25~34 | 35~39 | 40~44 | 45~54 | 55~64 | 65~74 | 75~83 | 84~89 | 90~99 |
| attained temperature [°C] when ink has been dried | 40 | 4 | — | 4 | 4 | 4 | 4 | 4 | 4 | 4 |
| | 50 | 4 | — | 4 | 4 | 4 | 4 | 4 | 4 | 4 |
| | 60 | — | 4 | — | 4 | 4 | 4 | 4 | 4 | 4 |
| | 70 | — | 4 | — | 4 | 4 | 4 | 4 | 4 | 4 |
| | 80 | — | 3 | — | 4 | 4 | 4 | 4 | 4 | 4 |
| | 85 | — | — | 2 | — | 3 | 3 | 3 | 4 | 4 |
| | 90 | — | — | 2 | — | 3 | 3 | 3 | 4 | 4 |
| | 100 | — | — | — | 1 | 3 | 3 | 3 | 4 | 4 |

FIG.10D

Table 4-4 Test results of adhesive performance depending on difference of paper type and paper thickness (4)
#10 *paper: Eye best W 210 gsm (made by Nippon Paper Industries Co., Ltd., and paper thickness: 0.21 [mm])

| | | attained temperature [°C] in heating before varnish is cured | | | | | | | | |
|---|---|---|---|---|---|---|---|---|---|---|
| | | 25~34 | 35~39 | 40~44 | 45~54 | 55~64 | 65~74 | 75~83 | 84~89 | 90~99 |
| attained temperature [°C] when ink has been dried | 40 | 4 | — | 4 | 4 | 4 | 4 | 4 | 4 | 4 |
| | 50 | 4 | — | 4 | 4 | 4 | 4 | 4 | 4 | 4 |
| | 60 | — | 4 | — | 3 | 4 | 4 | 4 | 4 | 4 |
| | 70 | — | 4 | — | 3 | 4 | 4 | 4 | 4 | 4 |
| | 80 | — | 3 | — | 3 | 4 | 4 | 4 | 4 | 4 |
| | 85 | — | — | 2 | — | 3 | 3 | 4 | 4 | 4 |
| | 90 | — | — | 2 | — | 3 | 3 | 3 | 4 | 4 |
| | 100 | — | — | — | 2 | 3 | 3 | 3 | 4 | 4 |

FIG.10E

Table 4-5 Test results of adhesive performance depending on difference of paper type and paper thickness (5)
#12 *paper: NEW DV 450 gsm (made by Hokuetsu Kishu Paper Co., Ltd., and paper thickness: 0.55 [mm])

| | | attained temperature [°C] in heating before varnish is cured | | | | | | | | |
|---|---|---|---|---|---|---|---|---|---|---|
| | | 25~34 | 35~39 | 40~44 | 45~54 | 55~64 | 65~74 | 75~83 | 84~89 | 90~99 |
| attained temperature [°C] when ink has been dried | 40 | 4 | — | 4 | 4 | 4 | 4 | 4 | 4 | 4 |
| | 50 | 4 | — | 4 | 4 | 4 | 4 | 4 | 4 | 4 |
| | 60 | — | 4 | — | 4 | 4 | 4 | 4 | 4 | 4 |
| | 70 | — | 4 | — | 4 | 4 | 4 | 4 | 4 | 4 |
| | 80 | — | 3 | — | 4 | 4 | 4 | 4 | 4 | 4 |
| | 85 | — | — | 2 | — | 4 | 4 | 4 | 4 | 4 |
| | 90 | — | — | 2 | — | 3 | 4 | 4 | 4 | 4 |
| | 100 | — | — | — | 2 | 3 | 4 | 4 | 4 | 4 |

FIG.10F

Table 4-6 Test results of adhesive performance depending on difference of paper type and paper thickness (6)
#14 * paper: OK TOPKOTE+ 127 gsm (made by Oji Paper Co., Ltd., and paper thickness: 0.11 [mm])

| | | attained temperature [°C] in heating before varnish is cured | | | | | | | | |
|---|---|---|---|---|---|---|---|---|---|---|
| | | 25~34 | 35~39 | 40~44 | 45~54 | 55~64 | 65~74 | 75~83 | 84~89 | 90~99 |
| attained temperature [°C] when ink has been dried | 40 | 4 | — | 4 | 4 | 4 | 4 | 4 | 4 | 4 |
| | 50 | 4 | — | 4 | 4 | 4 | 4 | 4 | 4 | 4 |
| | 60 | — | 4 | — | 4 | 4 | 4 | 4 | 4 | 4 |
| | 70 | — | 4 | — | 4 | 4 | 4 | 4 | 4 | 4 |
| | 80 | — | 3 | — | 4 | 4 | 4 | 4 | 4 | 4 |
| | 85 | — | — | 2 | — | 3 | 3 | 3 | 4 | 4 |
| | 90 | — | — | 1 | — | 3 | 3 | 3 | 4 | 4 |
| | 100 | — | — | — | 1 | 3 | 3 | 3 | 4 | 4 |

FIG.11A

Table 5-1 Test results of adhesive performance depending on difference of amount of ink (1)
*amount of ink: 3.0 [pL]

| | | attained temperature [°C] in heating before varnish is cured | | | | | | | | |
|---|---|---|---|---|---|---|---|---|---|---|
| | | 25~34 | 35~39 | 40~44 | 45~54 | 55~64 | 65~74 | 75~83 | 84~89 | 90~99 |
| attained temperature [°C] when ink has been dried | 40 | 4 | — | 4 | 4 | 4 | 4 | 4 | 4 | 4 |
| | 50 | 4 | — | 4 | 4 | 4 | 4 | 4 | 4 | 4 |
| | 60 | — | 4 | — | 4 | 4 | 4 | 4 | 4 | 4 |
| | 70 | — | 4 | — | 4 | 4 | 4 | 4 | 4 | 4 |
| | 80 | — | 3 | — | 4 | 4 | 4 | 4 | 4 | 4 |
| | 85 | — | — | 2 | — | 3 | 3 | 3 | 4 | 4 |
| | 90 | — | — | 2 | — | 3 | 3 | 3 | 4 | 4 |
| | 100 | — | — | — | 1 | 3 | 3 | 3 | 4 | 4 |

FIG.11B

Table 5-2 Test results of adhesive performance depending on difference of amount of ink (2)
*amount of ink: 1.0 [pL]

| | | attained temperature [°C] in heating before varnish is cured | | | | | | | | |
|---|---|---|---|---|---|---|---|---|---|---|
| | | 25~34 | 35~39 | 40~44 | 45~54 | 55~64 | 65~74 | 75~83 | 84~89 | 90~99 |
| attained temperature [°C] when ink has been dried | 40 | 4 | — | 4 | 4 | 4 | 4 | 4 | 4 | 4 |
| | 50 | 4 | — | 4 | 4 | 4 | 4 | 4 | 4 | 4 |
| | 60 | — | 4 | — | 4 | 4 | 4 | 4 | 4 | 4 |
| | 70 | — | 4 | — | 4 | 4 | 4 | 4 | 4 | 4 |
| | 80 | — | 3 | — | 4 | 4 | 4 | 4 | 4 | 4 |
| | 85 | — | — | 2 | — | 3 | 3 | 3 | 4 | 4 |
| | 90 | — | — | 2 | — | 3 | 3 | 3 | 4 | 4 |
| | 100 | — | — | — | 2 | 3 | 3 | 3 | 4 | 4 |

FIG.11C

Table 5-3 Test results of adhesive performance depending on difference of amount of ink (3)
*amount of ink: 5.0 [pL]

| | | attained temperature [°C] in heating before varnish is cured | | | | | | | | |
|---|---|---|---|---|---|---|---|---|---|---|
| | | 25~34 | 35~39 | 40~44 | 45~54 | 55~64 | 65~74 | 75~83 | 84~89 | 90~99 |
| attained temperature [°C] when ink has been dried | 40 | 4 | — | 4 | 4 | 4 | 4 | 4 | 4 | 4 |
| | 50 | 4 | — | 4 | 4 | 4 | 4 | 4 | 4 | 4 |
| | 60 | — | 4 | — | 4 | 4 | 4 | 4 | 4 | 4 |
| | 70 | — | 4 | — | 4 | 4 | 4 | 4 | 4 | 4 |
| | 80 | — | 3 | — | 4 | 4 | 4 | 4 | 4 | 4 |
| | 85 | — | — | 2 | — | 3 | 4 | 4 | 4 | 4 |
| | 90 | — | — | 2 | — | 3 | 3 | 4 | 4 | 4 |
| | 100 | — | — | — | 1 | 3 | 3 | 4 | 4 | 4 |

FIG.12A

Table 6-1 Test results of adhesive performance depending on difference of surface recording / rear face recording (1)
*surface recording

| | | attained temperature [°C] in heating before varnish is cured | | | | | | | | |
|---|---|---|---|---|---|---|---|---|---|---|
| | | 25~34 | 35~39 | 40~44 | 45~54 | 55~64 | 65~74 | 75~83 | 84~89 | 90~99 |
| attained temperature [°C] when ink has been dried | 40 | 4 | — | 4 | 4 | 4 | 4 | 4 | 4 | 4 |
| | 50 | 4 | — | 4 | 4 | 4 | 4 | 4 | 4 | 4 |
| | 60 | — | 4 | — | 4 | 4 | 4 | 4 | 4 | 4 |
| | 70 | — | 4 | — | 4 | 4 | 4 | 4 | 4 | 4 |
| | 80 | — | 3 | — | 4 | 4 | 4 | 4 | 4 | 4 |
| | 85 | — | — | 2 | — | 3 | 3 | 3 | 4 | 4 |
| | 90 | — | — | 2 | — | 3 | 3 | 3 | 4 | 4 |
| | 100 | — | — | — | 1 | 3 | 3 | 3 | 4 | 4 |

FIG.12B

Table 6-2 Test results of adhesive performance depending on difference of surface recording / rear face recording (2)
*rear face recording

| | | attained temperature [°C] in heating before varnish is cured | | | | | | | | |
|---|---|---|---|---|---|---|---|---|---|---|
| | | 25~34 | 35~39 | 40~44 | 45~54 | 55~64 | 65~74 | 75~83 | 84~89 | 90~99 |
| attained temperature [°C] when ink has been dried | 40 | 4 | — | 4 | 4 | 4 | 4 | 4 | 4 | 4 |
| | 50 | 4 | — | 4 | 4 | 4 | 4 | 4 | 4 | 4 |
| | 60 | — | 4 | — | 3 | 4 | 4 | 4 | 4 | 4 |
| | 70 | — | 4 | — | 3 | 4 | 4 | 4 | 4 | 4 |
| | 80 | — | 3 | — | 3 | 4 | 4 | 4 | 4 | 4 |
| | 85 | — | — | 2 | — | 3 | 3 | 3 | 4 | 4 |
| | 90 | — | — | 2 | — | 3 | 3 | 3 | 4 | 4 |
| | 100 | — | — | — | 1 | 3 | 3 | 3 | 4 | 4 |

IMAGE RECORDING APPARATUS AND METHOD, AND VARNISH APPLICATION DEVICE AND METHOD

CROSS-REFERENCE TO RELATED APPLICATIONS

The patent application claims priority under 35 U.S.C. §119 to Japanese Patent Application No. 2014-040486, filed on Mar. 3, 2014. Each of the above application(s) is hereby expressly incorporated by reference, in its entirety, into the present application.

BACKGROUND OF THE INVENTION

1. Field of the Invention

The present invention relates to an image recording apparatus and method, and a varnish application device and method; and particularly relates to an image recording apparatus and method for recording an image by using an ink containing a wax component and then applying varnish onto the surface of the image, and the varnish application device and method.

2. Description of the Related Art

As for a method for enhancing a scratch resistance of an image which has been recorded on a medium (recording target), a method of recording the image by using an ink containing a wax component (wax component-containing ink) is known (for instance, Japanese Patent Application Laid-Open No. 2013-82209 and the like). According to this method, the wax component functions as a sliding agent, and the scratch resistance of the image is enhanced.

In addition, a method of coating the surface of the image with varnish after having recorded the image is also known (for instance, Japanese Patent Application Laid-Open No. 2010-173286 and the like), as a method for enhancing the scratch resistance. This method has an advantage of being capable of enhancing also the glossiness of the image, in addition to an advantage of being capable of enhancing the scratch resistance. For this reason, such a method is also employed as to record an image by using the wax component containing ink, and further apply varnish onto the surface of the image.

SUMMARY OF THE INVENTION

However, when the varnish has been applied onto the surface of the image which has been recorded with the wax component containing ink, there is the case where the adhesiveness of the varnish is poor, and the varnish tends to easily come off.

The present invention has been made with respect to such circumstances, and an object of the present invention is to provide an image recording apparatus and method which can ensure the adhesiveness of the varnish that has been applied onto the surface of the image, and a varnish application device and method.

Devices for achieving the above described object are as follows.

The first aspect is an image recording apparatus which includes: an image recording unit that records an image on a medium by using an ink containing a wax component; an ink drying unit that heats the surface of the image on the medium on which the image has been recorded by the image recording unit, and dries the ink; a varnish application unit that applies an active ray-curing type of varnish onto the surface of the image on the medium on which the ink has been dried by the ink drying unit; a varnish curing unit that irradiates the surface of the image on the medium on which the varnish has been applied by the varnish application unit with active rays, and thereby cures the varnish; a heating unit before a curing of the varnish, which heats the surface of the image on the medium, before the varnish that has been applied onto the surface of the image on the medium by the varnish application unit is cured by the varnish curing unit; a unit of acquiring information on attained temperature when the ink has been dried, which acquires the information on the attained temperature T1 when the ink has been dried, when the attained temperature of the surface of the image on the medium when the ink has been dried by the ink drying unit is defined as the attained temperature T1 when the ink has been dried; a melting point information acquiring unit which acquires information on a melting point TW of the wax component; and a control unit of heating before the curing of the varnish, which compares the attained temperature T1 when the ink has been dried with the melting point TW of the wax component, and when T1≥TW holds, makes the heating unit before the curing of the varnish operate and heat the surface of the image on the medium.

The present inventors have found out that the phenomenon that the varnish which has been applied onto the image that has been recorded by using the ink containing the wax component tends to easily come off originates in an operation that when the ink is dried, the surface of the image is heated to the melting point of the wax component or higher. Specifically, when the surface of the image is heated to the melting point of the wax component or higher, the wax component results in being nonuniformly distributed on the surface of the ink layer (in other words, wax component rises to surface of ink layer), and when the varnish has been applied onto the surface of the image after this, the adhesiveness of the varnish decreases due to the action of the wax component which has been nonuniformly distributed on the surface of the ink layer.

Accordingly, in the case where the image is recorded on the medium and then the ink is heated and dried, the adhesiveness of the varnish can be ensured, as long as the surface of the image is not heated to the melting point of the wax component or higher.

On the other hand, there is also the case where the ink cannot be sufficiently dried if the surface of the image is not heated to the melting point of the wax component or higher, depending on the type of an ink to be used, the type of a medium to be used, and an image to be recorded. For instance, in the case where the image is recorded on paper having a thick thickness with the use of an aqueous ink, and/or in the case where an image is recorded with a large amount of the ink which is used, the ink cannot be sufficiently dried if the surface of the image is not heated to the melting point of the wax component or higher, and such a problem that the strength of an ink film (image) becomes insufficient and the like occur.

Thus, in the present aspect, an active ray-curing type of varnish (varnish which is cured when being irradiated with active rays) is used as a varnish, and when the surface of the image is heated to the melting point of the wax component or higher, the surface of the image shall be heated after the varnish has been applied onto the surface and before the varnish is cured. Thereby, the varnish can be prevented from coming off even though the surface of the image has been heated to the melting point of the wax component or higher when the ink is dried. The reason is as follows. Specifically, when the varnish is applied onto the surface of the image and then the surface of the image is heated before the varnish is cured, the wax component which has been nonuniformly distributed on the surface of the ink layer can be dissolved into the varnish layer again, and the wax component which has been nonuniformly distributed on the surface of the ink layer can be removed. Thereby, the adhesiveness between the ink layer and the varnish layer can be ensured, and the varnish can be prevented from coming off.

The second aspect is an aspect that in the image recording apparatus of the first aspect, the control unit of heating before the curing of the varnish makes the heating unit before the curing of the varnish operate and heat the surface of the image on the medium to the melting point TW of the wax component or higher, when T1≥TW holds.

In the present aspect, when the surface of the image is heated prior to the curing of the varnish (in other words, when T1≥TW holds), the surface of the image is heated to the melting point TW of the wax component or higher. Thereby, the wax component which has been nonuniformly distributed on the surface of the ink layer can be efficiently dissolved into the varnish layer again, and the wax component which has been nonuniformly distributed on the surface of the ink layer can be efficiently removed. Thereby, the adhesiveness of the varnish can be further enhanced.

A third aspect is an aspect that in the image recording apparatus of the first or second aspect, the unit of acquiring the information on the attained temperature when the ink has been dried measures a temperature of the surface of the image on the medium in the ink drying unit, and acquires the information on the attained temperature T1 when the ink has been dried.

In the present aspect, when acquiring the information on the attained temperature T1 when the ink has been dried, the above unit directly measures and acquires the temperature of the surface of the image of the medium in the ink drying unit. Thereby, the above unit can accurately acquire the attained temperature T1 when the ink has been dried. Incidentally, the attained temperature is the highest attained temperature.

A fourth aspect is an aspect that in the image recording apparatus of the first or second aspect, the unit of acquiring the information on the attained temperature when the ink has been dried includes: a unit for acquiring a parameter for estimating the attained temperature when the ink has been dried, which acquires at least one information out of information on a thickness of the medium, information on a type of the medium, information on an amount of the ink to be given onto the medium, and information on a type of surface recording/rear face recording, as a parameter for estimating the attained temperature when the ink has been dried; and a unit for estimating the attained temperature when the ink has been dried, which estimates the attained temperature T1 when the ink has been dried, on the basis of the parameter for estimating the attained temperature when the ink has been dried, which is acquired by the unit for acquiring the parameter for estimating the attained temperature when the ink has been dried.

In the present aspect, when acquiring the information on the attained temperature T1 when the ink has been dried, the above unit acquires at least one information out of the information on the thickness of the medium, the information on the type of the medium, the information on the amount of the ink to be given onto the medium, and the information on the type of surface recording/rear face recording, as the parameter for estimating the attained temperature when the ink has been dried, estimates the attained temperature T1 when the ink has been dried from the parameter for estimating the attained temperature when the ink has been dried, and acquires the attained temperature T1. In other words, when the ink is heated and dried in the ink drying unit, it can be estimated to some extent what temperature the surface of the image reaches, from the information on the thickness of the medium, the type of the medium and the amount of the ink to be given to the medium, and accordingly the attained temperature T1 when the ink has been dried is estimated with the use of these information. Thereby, the information on the attained temperature T1 when the ink has been dried can be acquired, even though the temperature of the surface of the image on the medium is not directly measured in the ink drying unit.

Incidentally, "information on type of surface recording/rear face recording" means the same content as information about whether the image is to be recorded on a medium having an image already recorded thereon or not. Accordingly, in the case where the image is recorded on both surfaces of the medium, only the case where the image is recorded on the rear face (face in opposite side to face having image already recorded thereon (this face shall be referred to as surface)) shall be referred to as rear face recording. (The case where image is recorded on surface in the case where image is recorded on both surface of medium and the case where image is recorded only on one surface of medium shall be referred to as surface recording.)

A fifth aspect is an aspect that in the image recording apparatus of the fourth aspect, the unit for estimating the attained temperature when the ink has been dried has a table for estimating the attained temperature when the ink has been dried, in which a relationship between the parameter for estimating the attained temperature when the ink has been dried and the attained temperature T1 when the ink has been dried is specified, and estimates the attained temperature T1 when the ink has been dried, with reference to the table for estimating the attained temperature when the ink has been dried.

In the present aspect, the above unit prepares the table for estimating the attained temperature when the ink has been dried, in which the relationship between the parameter for estimating the attained temperature when the ink has been dried and the attained temperature T1 when the ink has been dried is specified beforehand, and estimates the attained temperature T1 when the ink has been dried, with reference to the table for estimating the attained temperature when the ink has been dried. Thereby, the above unit can simply and promptly acquire the information on the attained temperature T1 when the ink has been dried.

A sixth aspect is an aspect that in the image recording apparatus of any one aspect out of the first to fifth aspects, the image recording unit records the image onto the medium with an ink jet method.

In the present aspect, the above unit records the image on the medium with the ink jet method (marking method of separating liquid (ink) containing coloring material and functional material into droplets, ejecting the droplets toward medium according to image signal (print signal), and depositing and transmitting coloring material and functional material onto object). Thereby, the scratch resistance and the glossiness of the image which has been recorded by the ink jet method can be enhanced, and the quality and the durability thereof can be enhanced.

A seventh aspect is a varnish application device which applies an active ray-curing type of varnish onto the surface of the image on the medium on which an image has been recorded with the use of an ink containing a wax component, then the surface of the image has been heated and the ink has been dried, and includes: a varnish application unit which applies the varnish onto the surface of the image on the medium; a varnish curing unit that irradiates the surface of the image on the medium on which the varnish has been applied by the varnish application unit, with active rays, and thereby cures the varnish; a heating unit before a curing of the varnish, which heats the surface of the image on the medium, before the varnish that has been applied onto the surface of the image on the medium by the varnish application unit is cured by the varnish curing unit; a unit of acquiring information on attained temperature when the ink has been dried, which acquires the information on the attained temperature T1 when the ink has been dried, when the attained temperature of the surface of the image on the medium when the ink has been dried is defined as the attained temperature T1 when the ink has been dried; a melting point information acquiring unit which acquires information on a melting point TW of the wax component; and a control unit of heating before the curing of the varnish, which compares the attained temperature T1 when the ink has been dried with the melting point TW of the wax component, and when T1≥TW holds, makes the heating unit before the curing of the varnish operate and heat the surface of the image on the medium.

In the present aspect, when the medium on which the surface of the image has been heated to the melting point of the wax component or higher when the ink has been dried is an object to be treated, the surface of the image is heated after the varnish has been applied in the varnish application step and before the varnish is cured in the varnish curing step. Thereby, the wax component which has been nonuniformly distributed on the surface of the ink layer can be removed, and the adhesiveness between the ink layer and the varnish layer can be ensured.

An eighth aspect is an aspect that in the varnish application device of the seventh aspect, the control unit of heating before the curing of the varnish makes the heating unit before the curing of the varnish operate and heat the surface of the image on the medium to the melting point TW of the wax component or higher, when T1≥TW holds.

In the present aspect, when the surface of the image is heated prior to the curing of the varnish (in other words, when T1≥TW holds), the surface of the image is heated to the melting point TW of the wax component or higher. Thereby, the wax component which has been nonuniformly distributed on the surface of the ink layer can be efficiently dissolved into the varnish layer again, and the wax component which has been nonuniformly distributed on the surface of the ink layer can be efficiently removed. Thereby, the adhesiveness of the varnish can be further enhanced.

A ninth aspect is an aspect that in the varnish application device of the seventh or eighth aspect, the unit of acquiring the information on the attained temperature when the ink has been dried includes: a unit for acquiring a parameter for estimating the attained temperature when the ink has been dried, which acquires at least one information out of information on a thickness of the medium, information on a type of the medium, information on an amount of the ink to be given onto the medium, and information on a type of surface recording/rear face recording, as a parameter for estimating the attained temperature when the ink has been dried; and a unit for estimating the attained temperature when the ink has been dried, which estimates the attained temperature T1 when the ink has been dried on the basis of the parameter for estimating the attained temperature when the ink has been dried, which is acquired by the unit for acquiring the parameter for estimating the attained temperature when the ink has been dried.

In the present aspect, when acquiring the information on the attained temperature T1 when the ink has been dried, the above unit acquires at least one information out of the information on the thickness of the medium, the information on the type of the medium, the information on the amount of the ink to be given onto the medium, and the information on the type of surface recording/rear face recording, as the parameter for estimating the attained temperature when the ink has been dried, estimates the attained temperature T1 when the ink has been dried from the parameter for estimating the attained temperature when the ink has been dried, and acquires the attained temperature T1. Thereby, the information on the attained temperature T1 when the ink has been dried can be acquired, even though the temperature of the surface of the image on the medium is not directly measured when the ink has been dried.

A tenth aspect is an aspect that in the varnish application device of the ninth aspect, the unit for estimating the attained temperature when the ink has been dried has a table for estimating the attained temperature when the ink has been dried, in which a relationship between the parameter for estimating the attained temperature when the ink has been dried and the attained temperature T1 when the ink has been dried is specified, and estimates the attained temperature T1 when the ink has been dried, with reference to the table for estimating the attained temperature when the ink has been dried.

In the present aspect, the above unit prepares the table for estimating the attained temperature when the ink has been dried, in which the relationship between the parameter for estimating the attained temperature when the ink has been dried and the attained temperature T1 when the ink has been dried is specified beforehand, and estimates the attained temperature T1 when the ink has been dried, with reference to the table for estimating the attained temperature when the ink has been dried. Thereby, the above unit can simply and promptly acquire the information on the attained temperature T1 when the ink has been dried.

An eleventh aspect is an image recording method which includes: an image recording step of recording an image on a medium with the use of an ink containing a wax component; an ink drying step of heating the surface of the image on the medium on which the image has been recorded in the image recording step, and drying the ink; a varnish application step of applying an active ray-curing type varnish onto the surface of the image on the medium on which the ink has been dried in the ink drying step; and a varnish curing step of irradiating the surface of the image on the medium which has the varnish applied onto the surface of the image in the varnish application step, with active rays, and thereby curing the varnish, wherein the image recording method further includes: a determining step of comparing an attained temperature T1 when the ink has been dried with a melting point TW of the wax component, where an attained temperature of the surface of the image on the medium when the ink has been dried in the ink drying step is defined as the attained temperature T1 when the ink has been dried, and determining whether T1≥TW holds or not; and a heating step before a curing of the varnish, of heating the surface of the image on the medium before the varnish that has been applied onto the surface of the image on the medium in the varnish application step is cured in the varnish curing step, when T1≥TW holds.

In the present aspect, the image recording method includes: the image recording step of recording the image on the medium with the use of the ink containing the wax component; the ink drying step of heating the surface of the image on the medium, and drying the ink; the varnish application step of applying the active ray-curing type varnish onto the surface of the image on the medium; and the varnish curing step of irradiating the surface of the image on the medium on which the varnish has been applied, with active rays, and thereby curing the varnish, and further includes: the determining step of comparing the attained temperature T1 when the ink has been dried with the melting point TW of the wax component, and determining whether T1≥TW holds or not; and the heating step before a curing of the varnish, of heating the surface of the image on the medium before the varnish that has been applied onto the surface of the image on the medium in the varnish application step is cured in the varnish curing step. Thereby, the adhesiveness between the ink layer and the varnish layer can be ensured, even in the case where the surface of the image has been heated to the melting point of the wax component or higher when the ink has been dried, and the varnish can be prevented from coming off.

A twelfth aspect is an aspect that in the image recording method of the eleventh aspect, the heating step before the curing of the varnish is a step of heating the surface of the image on the medium to the melting point TW of the wax component or higher, when T1≥TW holds.

In the present aspect, when the surface of the image is heated in the heating step before the curing of the varnish, the surface of the image is heated to the melting point TW of the wax component or higher. Thereby, the wax component which has been nonuniformly distributed on the surface of the ink layer can be efficiently dissolved into the varnish layer again, and the wax component which has been nonuniformly distributed on the surface of the ink layer can be efficiently removed. Thereby, the adhesiveness of the varnish can be further enhanced.

A thirteenth aspect is a varnish application method that applies an active ray-curing type of varnish onto the surface of an image on a medium on which the image has been recorded with the use of an ink containing a wax component, then the surface of the image has been heated and the ink has been dried, including: a varnish application step of applying the varnish onto the surface of the image on the medium; and a varnish curing step of irradiating the surface of the image on the medium on which the varnish has been applied in the varnish application step, with active rays, and thereby curing the varnish, wherein the varnish application method further includes: a determining step of comparing an attained temperature T1 when the ink has been dried with a melting point TW of the wax component, where an attained temperature of the surface of the image on the medium when the ink has been dried is defined as the attained temperature T1 when the ink has been dried, and determining whether T1≥TW holds or not; and a heating step before a curing of the varnish, of heating the surface of the image on the medium before the varnish that has been applied onto the surface of the image on the medium in the varnish application step is cured in the varnish curing step, when T1≥TW holds.

In the present aspect, the varnish application method which includes: the varnish application step of applying the varnish; the varnish curing step of irradiating the surface of the image on the medium on which the varnish has been applied, with active rays, and thereby curing the varnish; and the heating step before the curing of the varnish, of heating the surface of the image on the medium before the surface of the image on the medium on which the varnish has been applied is irradiated with the active rays, and is cured, and further includes: the determining step of comparing the attained temperature T1 when the ink has been dried with the melting point TW of the wax component, and determining whether T1≥TW holds or not; and the heating step before the curing of the varnish, of heating the surface of the image on the medium before the varnish that has been applied onto the surface of the image on the medium in the varnish application step is cured in the varnish curing step. Thereby, the adhesiveness between the ink layer and the varnish layer can be ensured, even in the case where the varnish is applied to the medium of which the surface of the image has been heated to the melting point of the wax component or higher when the ink has been dried, and the varnish can be prevented from coming off.

A fourteenth aspect is an aspect that in the varnish application method of the thirteenth aspect, the heating step before the curing of the varnish is a step of heating the surface of the image on the medium to the melting point TW of the wax component or higher, when T1≥TW holds.

In the present aspect, when the surface of the image is heated in the heating step before the curing of the varnish, the surface of the image is heated to the melting point TW of the wax component or higher. Thereby, the wax component which has been nonuniformly distributed on the surface of the ink layer can be efficiently dissolved into the varnish layer again, and the wax component which has been nonuniformly distributed on the surface of the ink layer can be efficiently removed. Thereby, the adhesiveness of the varnish can be further enhanced.

According to the present invention, the adhesiveness of the varnish can be ensured which has been applied onto the surface of the image that has been recorded with the ink containing the wax component.

BRIEF DESCRIPTION OF THE DRAWINGS

FIG. 7 is a table showing a test result of a test (test 1) for evaluating an adhesiveness of varnish;

FIGS. 8A to 8C are tables showing a test result of a test (test 2) for evaluating the adhesiveness of the varnish;

FIGS. 9 A to 9C are tables showing a test result of a test (test 3) for evaluating the adhesiveness of the varnish;

FIGS. 10A to 10F are tables showing a test result of a test (test 4) for evaluating the adhesiveness of the varnish;

FIGS. 11A to 11C are tables showing a test result of a test (test 5) for evaluating the adhesiveness of the varnish; and FIGS. 12A and 12B are tables showing a test result of a test (test 6) for evaluating the adhesiveness of the varnish.

DETAILED DESCRIPTION OF THE PREFERRED EMBODIMENTS

Preferable embodiments according to the present invention will be described below with reference to the attached drawings.

<<Whole Structure of Image Recording Apparatus>>

Figure 1:
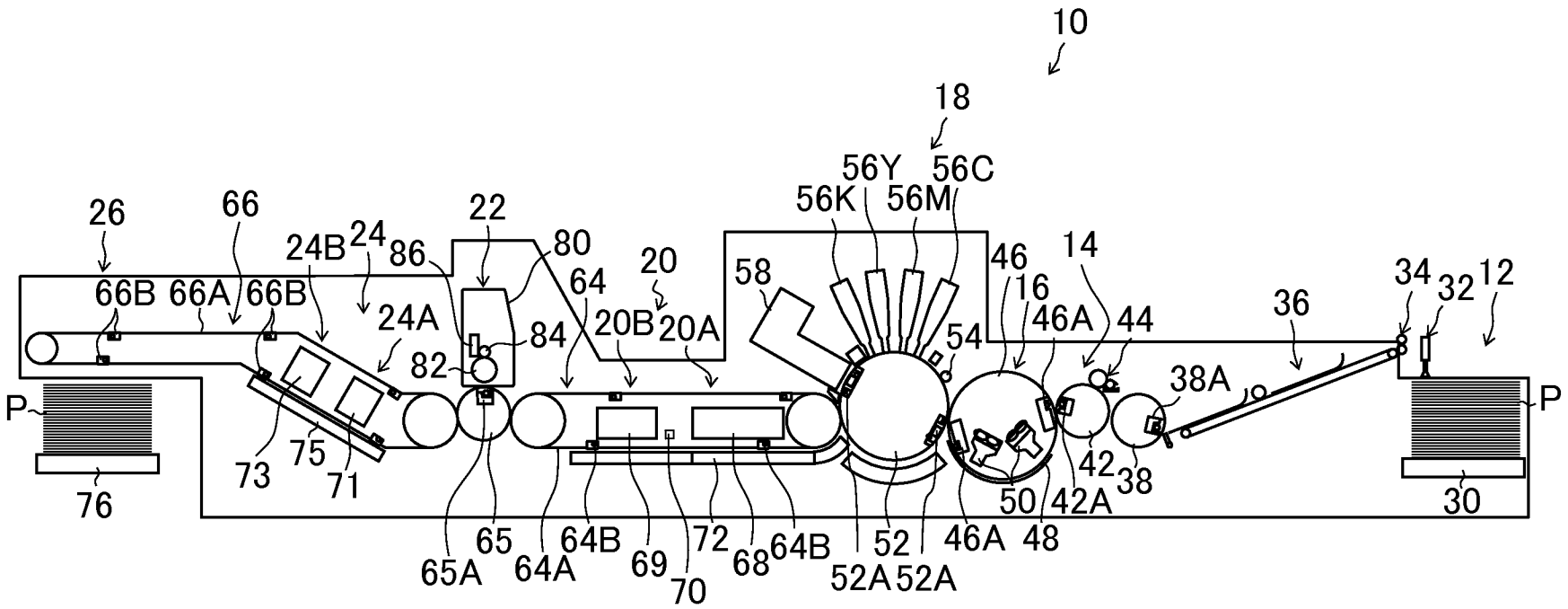
FIG. 1 is a whole schematic diagram showing one embodiment of an image recording apparatus.

FIG. 1 is a whole schematic diagram showing one embodiment of an image recording apparatus.

This image recording apparatus 10 is an image recording apparatus (ink jet recording device) which records an image onto a sheet (hereinafter referred to as "paper") P with an ink jet method, coats the surface of the recorded image with varnish, and outputs the coated image, and includes: a paper feeding portion 12 which feeds the paper P; a treatment-liquid application portion 14 which applies a treatment liquid onto the paper P; a treatment-liquid drying portion 16 which dries the applied treatment liquid; an image recording unit 18 which records the image onto the paper P on which the treatment liquid has been dried; an image post-treatment unit 20 which subjects the image that has been recorded on the paper P to post treatment; a varnish application unit 22 which applies a varnish onto the surface of the image that has been subjected to the post treatment; a varnish post-treatment unit 24 which subjects the varnish that has been applied, to post treatment; and a paper ejection portion 26 which ejects the paper P.

Incidentally, the image recording apparatus 10 of the present aspect is structured as an image recording apparatus which can employ an ultraviolet curing type of aqueous ink. Here, the aqueous ink means an ink which has a coloring material such as dye and pigment dissolved or dispersed in water and a solvent that is soluble in water. In addition, the ultraviolet curing type of aqueous ink means an ink which is cured by irradiation with ultraviolet rays (UV; ultraviolet). The image recording apparatus which records the image by using the ultraviolet curing type of aqueous ink (aqueous UV ink) requires a treatment of drying ink (treatment of removing liquid component remaining on surface of paper P) and a treatment of UV-curing ink (treatment of irradiating image with UV light to cure image), as post treatment (image post-treatment) to be performed after the image has been recorded.

In addition, the image recording apparatus 10 of the present aspect is structured as an image recording apparatus which can employ an ultraviolet curing type of varnish (UV varnish). The UV varnish is a varnish which is cured by irradiation with UV light. When the UV varnish is used, UV curing treatment (treatment of irradiating image with UV light, and curing image) is needed as a post treatment (varnish post treatment) to be performed after the varnish has been applied.

<Paper Feeding Portion>

The paper feeding portion 12 includes mainly a paper feeding table 30, a sucker device 32, a pair of paper feeding rollers 34, a feeder board 36 and a paper feeding drum 38.

Paper P which is a medium is mounted on the paper feeding table 30 in the state of having been stacked (in state of so-called paper bundle). As for the paper P, for instance, a general-purpose printing paper is used. The general-purpose printing paper does not mean a so-called ink-jet exclusive paper but means paper such as coated paper which is generally used for offset printing and contains mainly cellulose.

The sucker device 32 sequentially pulls up sheets of paper P which are stacked on the paper feeding table 30, from the top one by one, and feeds the pulled up paper to the pair of paper feeding rollers 34.

The pair of paper feeding rollers 34 send out the paper P which is fed from the sucker device 32, toward the feeder board 36.

The feeder board 36 receives the paper P which has been sent out from the pair of paper feeding rollers 34, and conveys the received paper P toward the paper feeding drum 38.

The paper feeding drum 38 receives the paper P which has been conveyed by the feeder board 36, and conveys the received paper P toward the treatment-liquid application portion 14. The paper feeding drum 38 conveys the paper P along a fixed conveyance path by grasping the tip of the paper P with a gripper 38A and rotating the paper P.

<Treatment-Liquid Application Portion>

The treatment-liquid application portion 14 performs a treatment of applying a treatment liquid (liquid containing ink agglomerating agent) having a function of agglomerating a coloring material component in the ink, onto an image recording face of the paper P. Such a treatment liquid is applied beforehand, and the image is recorded. Thereby, even when the general-purpose printing paper is used, an image of high quality can be recorded. The treatment-liquid application portion 14 includes mainly a treatment liquid drum 42 which constitutes a conveyance device of the paper P, and a treatment-liquid application device 44 which applies the treatment liquid onto the surface of the paper P.

The treatment liquid drum 42 receives the paper P from the paper feeding drum 38, and conveys the received paper P toward the treatment-liquid drying portion 16. The treatment liquid drum 42 conveys the paper P while winding the paper P on the peripheral surface by grasping the tip of the paper P with a gripper 42A and rotating the paper P. The paper P is wound around the treatment liquid drum 42 in the state in which the image recording face is faced to the outside, and is conveyed.

The treatment-liquid application device 44 applies the treatment liquid onto the image recording face of the paper P which is conveyed by the treatment liquid drum 42. The application method is not limited in particular. For instance, a method of applying a treatment liquid with the use of an application roller can be adopted (method of pressing application roller to which treatment liquid has been given against image recording face of paper P, and applying treatment liquid onto image recording face of paper P). In addition to this method, application methods such as an ink jet method and a spraying method can also be adopted.

The paper P which has been delivered to the treatment liquid drum 42 from the paper feeding drum 38 passes through the treatment-liquid application device 44 in a process of being conveyed by the treatment liquid drum 42, and when the paper P passes therethrough, the treatment liquid is applied onto the image recording face.

<Treatment-Liquid Drying Portion>

The treatment-liquid drying portion 16 performs a treatment of drying the treatment liquid which has been applied onto the paper P. The treatment-liquid drying portion 16 includes mainly a treatment-liquid drying drum 46 which constitutes the conveyance device of the paper P, a paper conveyance guide 48 which guides the conveyance of the paper P, and a treatment liquid drier 50 which sends hot air toward the paper P.

The treatment-liquid drying drum 46 receives the paper P from the treatment liquid drum 42, and conveys the received paper P toward the image recording unit 18. The treatment-liquid drying drum 46 conveys the paper P along a fixed conveyance path by grasping the tip of the paper P with a gripper 46A and rotating the paper P. The paper P is conveyed in the state in which the image recording face (=treatment-liquid applied face) is faced to the inside.

The paper conveyance guide 48 is arranged along the conveyance path through which the paper P is conveyed by the treatment-liquid drying drum 46, and guides the conveyance of the paper P. The paper P is conveyed while sliding on this paper conveyance guide 48. (The paper P is conveyed while face in opposite side to image recording face on which treatment liquid has been applied slides on paper conveyance guide 48.)

The treatment liquid drier 50 blows hot air onto the image recording face (=treatment-liquid applied face) of the paper P which is conveyed by the treatment-liquid drying drum 46, and heats the image recording face. The treatment liquid drier 50 is arranged in the inside of the treatment-liquid drying drum 46, so as to heat the image recording face. The treatment liquid drier 50 includes a heat source such as a halogen heater and an infrared (IR; infrared radiation) heater, for instance, and a blowing device (fan or blower) which sends air (gas or fluid) that has been heated by the heat source. When the treatment liquid drier 50 is structured of the heater and the blowing device, the treatment liquid drier 50 can control its heat intensity by the number of lit heaters and the lighting duty.

The hot air sent from the treatment liquid drier 50 is blown onto the image recording face of the paper P which has been delivered to the treatment-liquid drying drum 46 from the paper feeding drum 38, in a process of being conveyed by the treatment-liquid drying drum 46. Thereby, the image recording face is heated, and the solvent component in the treatment liquid is dried and removed. As a result, the ink agglomerating layer (layer of ink agglomerating agent contained in treatment liquid) is formed on the image recording face of the paper P.

<Image Recording Unit>

The image recording unit 18 performs a treatment of recording the image onto the image recording face of the paper P, with the ink jet method. The image recording unit 18 mainly includes: an image recording drum 52 which constitutes the conveyance device of the paper P; a paper pressing roller 54; ink jet heads 56C, 56M, 56Y and 56K which eject droplets of the ink (aqueous UV ink) of various colors of cyan (C), magenta (M), yellow (Y) and black (K), respectively, to the paper P; and an in-line sensor 58 which reads the image that has been recorded on the paper P.

The image recording drum 52 receives the paper P from the treatment-liquid drying drum 46, and conveys the received paper P toward the image post-treatment unit 20. The image recording drum 52 conveys the paper P while winding the paper P on the peripheral surface by grasping the tip of the paper P with a gripper 52A and rotating the paper P. At this time, the image recording drum 52 makes its peripheral surface adsorb the paper P and conveys the paper P, in order that the flatness of the paper P (which means having no lifting and wrinkle) is ensured. The adsorption of the paper P is performed by the suction through a large number of suction holes (suction by so-called negative pressure) which are provided on the peripheral surface of the image recording drum 52. The paper P is wound around the image recording drum 52 in the state in which the image recording face is faced to the outside, and is conveyed.

The paper pressing roller 54 presses the paper P against the image recording drum 52, and brings the paper P into close contact with the peripheral surface of the image recording drum 52.

The ink jet heads 56C, 56M, 56Y and 56K each eject ink droplets toward the image recording face of the paper P which is conveyed by the image recording drum 52, from a large number of nozzles provided on the respective nozzle faces thereof. These ink jet heads 56C, 56M, 56Y and 56K are structured of line type ink-jet heads. Specifically, each ink jet head is structured of an ink jet head which has a nozzle array having a length corresponding to the maximum paper width. Thereby, the image can be recorded on the whole region in the width direction of the paper P, in a single pass (one pass).

The ink jet heads 56C, 56M, 56Y and 56K are arranged at fixed intervals on the conveyance path of the paper P (in present example, arranged in order of cyan, magenta, yellow and black), and are arranged so that the nozzle arrays are each perpendicular to the conveyance direction of the paper P.

The in-line sensor 58 includes a line scanner, and reads the image which has been recorded on the image recording face of the paper P by the ink jet heads 56C, 56M, 56Y and 56K. Incidentally, the reading operation is performed, as needed. The presence or absence of an ejection failure is inspected from the read image.

The paper P which has been delivered to the image recording drum 52 from the treatment-liquid drying drum 46 passes under the ink jet heads 56C, 56M, 56Y and 56K, in a process of being conveyed by the image recording drum 52. When the paper P passes therethrough, each of the ink jet heads 56C, 56M, 56Y and 56K ejects ink droplets (ink droplet of each color of C, M, Y and K), the ejected ink droplets strike the image recording face, and a color image is recorded on the image recording face. The paper P which has passed through the ink jet heads 56C, 56M, 56Y and 56K further passes under the in-line sensor 58, and when the paper P passes therethrough, the image which has been recorded on the image recording face is read, as needed.

<Image Post-Treatment Unit>

The image post-treatment unit 20 performs post treatment on the image (image post-treatment) which has been recorded on the paper P. Specifically, the image post-treatment unit 20 performs a treatment of heating the surface of the image to dry the ink (ink drying treatment), and a treatment of irradiating the surface of the image of which the ink has been dried, with UV light, and UV-curing the ink (ink UV-curing treatment). The image post-treatment unit 20 includes: a chain gripper 64 for image post-treatment, which constitutes a conveyance device of the paper P; an ink drying unit 20A which performs the ink drying treatment on the paper P that is conveyed by the chain gripper 64 for the image post-treatment; and an ink UV-curing portion 20B which performs the UV-curing treatment on the paper P that is conveyed by the chain gripper 64 for the image post-treatment.

The chain gripper 64 for the image post-treatment receives the paper P from the image recording drum 52, and conveys the received paper P toward the varnish application unit 22. The chain gripper 64 for the image post-treatment is provided with an endless chain 64A which travels along a fixed traveling path; and grasps the tip of the paper P with a gripper 64B which is provided on the chain 64A, and conveys the paper P along the fixed conveyance path. The paper P is conveyed in the state in which the image recording face is faced to the inside of the chain gripper 64 for the image post-treatment.

Incidentally, in FIG. 1, reference numeral 72 is a guide plate 72 which guides the conveyance of the paper P. The paper P which is conveyed by the chain gripper 64 for the image post-treatment is conveyed while sliding on the guide face of the guide plate 72. At this time, the paper P slides on the guide face of the guide plate 72 while being sucked through a large number of suction holes provided on the guide face of the guide plate 72. Thereby, the paper P is conveyed while a fixed tension is applied thereto.

The ink drying unit 20A performs the treatment of heating the surface of the image of the paper P which is conveyed by the chain gripper 64 for the image post-treatment, and drying the ink. In the present embodiment, the ink drying unit 20A is structured so as to heat the image and dry the ink, by blowing hot air onto the surface of the image. Because of this, the ink drying unit 20A is structured of an ink drier 68 which sends the hot air. The ink drier 68 includes a heat source such as a halogen heater and an infrared heater, for instance, and a blowing device (fan or blower) which sends the air that has been heated by the heat source. As has been described above, the paper P is conveyed in the state in which the image recording face is faced to the inside of the chain gripper 64 for the image post-treatment. Because of this, the ink drier 68 is arranged in the inside of the chain gripper 64 for the image post-treatment. When the ink drier 68 is structured of the heater and the blowing device, the ink drier 68 can control its heat intensity by the number of lit heaters and the lighting duty.

In addition, the ink drying unit 20A is provided with a temperature sensor 70 in order to monitor the temperature of the surface of the heated image. The temperature sensor 70 is structured, for instance, of a radiation thermometer (thermometer which measures intensity of infrared rays and visible light emitted from object, and measures temperature of object).

The ink UV-curing portion 20B performs a treatment of irradiating the surface of the image of the paper P which is conveyed by the chain gripper 64 for the image post-treatment, with UV light, and UV-curing the ink. Because of this, the ink UV-curing portion 20B is structured of a UV-irradiation device 69 which is provided with the source of UV light. This UV-irradiation device 69 is also arranged in the inside of the chain gripper 64 for the image post-treatment.

The paper P is conveyed by the chain gripper 64 for the image post-treatment, and thereby firstly passes through the ink drying unit 20A. Then, when the paper P passes through the ink drying unit 20A, the hot air is blown to the image recording face, thereby the surface of the image is heated, and the ink is dried. The paper P which has passed through the ink drying unit 20A subsequently passes through the ink UV-curing portion 20B. Then, when the paper P passes through the ink UV-curing portion 20B, the image recording face is irradiated with UV light. Thereby, the ink is cured, and the image is fixed on the paper P.

<Varnish Application Unit>

The varnish application unit 22 performs a treatment of applying a varnish (UV varnish in present embodiment) onto the surface of the image which has been recorded on the paper P. The varnish application unit 22 mainly includes: a varnish drum 65 which constitutes the conveyance device of the paper P; and a varnish applying unit 80 which applies the varnish onto the surface of the image of the paper P that is conveyed by the varnish drum 65.

The varnish drum 65 receives the paper P from the chain gripper 64 for the image post-treatment, and conveys the received paper P toward the varnish post-treatment unit 24. The structure of the varnish drum 65 is the same as that of the treatment liquid drum 42, and conveys the paper P while winding the paper P on the peripheral surface by grasping the tip of the paper P with a gripper 65A and rotating the paper P. At this time, the paper P is conveyed in the state in which the image recording face (=varnish application face) is faced to the outside.

The varnish applying unit 80 mainly includes: a varnish application roller 82 which applies the varnish onto the image recording face of the paper P; a varnish supply roller 84 which supplies the varnish to the varnish application roller 82; and a varnish chamber 86 which supplies the varnish to the varnish supply roller 84.

The varnish application roller 82 is provided so as to be capable of abutting on and being separated from the varnish drum 65, and is made to abut on or be separated from the varnish drum 65 while matching the timing at which the paper P passes.

The varnish supply roller 84 is provided so as to be capable of abutting on and being separated from the varnish application roller 82. When the varnish supply roller 84 abuts on the varnish application roller 82, the varnish is thereby applied (transferred) to the peripheral surface of the varnish application roller 82 so as to give a fixed thickness.

The varnish chamber 86 supplies the varnish to the surface of the varnish supply roller 84 so as to give a fixed thickness. An unillustrated varnish supply device is connected to this varnish chamber 86, and the varnish is circulated and supplied.

When the varnish supply roller 84 abuts on the varnish application roller 82, the varnish which has been supplied to the varnish supply roller 84 from the varnish chamber 86 is thereby supplied to the surface of the varnish application roller 82 so as to give a fixed thickness. Then, this varnish application roller 82 to which the varnish has been supplied is made to abut on the image recording face of the paper P that is conveyed by the varnish drum 65. Thereby, the varnish is applied onto the image recording face of the paper P so as to give a fixed thickness.

<Varnish Post-Treatment Unit>

The varnish post-treatment unit 24 performs a post treatment of the varnish which has been applied onto the surface of the image in the varnish application unit 22. Specifically, the varnish post-treatment unit 24 performs a treatment of heating the surface of the image to which the varnish has been applied before the varnish is cured (heating treatment before curing of varnish), as needed, and a treatment of irradiating the surface of the image to which the varnish has been applied, with UV light, and curing the varnish (varnish curing treatment). The varnish post-treatment unit 24 includes: a chain gripper 66 for varnish post-treatment, which constitutes a conveyance device of the paper P; a heating unit 24A before a curing of the varnish is cured, which performs heating treatment before the curing of the varnish, on the paper P that is conveyed by the chain gripper 66 for the varnish post-treatment; and a varnish curing unit 24B which performs varnish curing treatment on the paper P that is conveyed by the chain gripper 66 for the varnish post-treatment.

The chain gripper 66 for the varnish post-treatment receives the paper P from the varnish drum 65, and conveys the received paper P toward the paper ejection portion 26. The chain gripper 66 for the varnish post-treatment is provided with an endless chain 66A which travels along a fixed traveling path; and grasps the tip of the paper P with a gripper 66B which is provided on the chain 66A, and conveys the paper P along the fixed conveyance path. The paper P is conveyed in the state in which the image recording face is faced to the inside of the chain gripper 66 for the varnish post-treatment.

Incidentally, in FIG. 1, reference numeral 75 is a guide plate 75 which guides the conveyance of the paper P. The paper P which is conveyed by the chain gripper 66 for the varnish post-treatment is conveyed while sliding on the guide face of the guide plate 75. At this time, the paper P slides on the guide face of the guide plate 75 while being sucked through a large number of suction holes provided on the guide face of the guide plate 75. Thereby, the paper P is conveyed while a fixed tension is applied to the paper P.

The heating unit 24A before the curing of the varnish performs a treatment of heating the surface of the image of the paper P which is conveyed by the chain gripper 66 for the varnish post-treatment. The heating by this heating unit 24A before the curing of the varnish is selectively performed, and is performed when the surface of the image has been heated to the melting point of the wax component or higher in the ink drying unit 20A, in the case where the image has been recorded with the use of the wax containing ink. Accordingly, even in the case where the image has been recorded with the use of the wax containing ink, the surface of the image is not heated when the surface of the image has not been heated to the melting point of the wax component or higher in the ink drying treatment. This point will be described later in detail.

In the present embodiment, the heating unit 24A before the curing of the varnish is structured so as to heat the surface of the image by blowing hot air onto the surface of the varnish. Because of this, the heating unit 24A before the curing of the varnish is structured of a heat unit 71 which sends the hot air. The heat unit 71 includes a heat source such as a halogen heater and an infrared heater, for instance, and a blowing device (fan or blower) which sends the air that has been heated by the heat source. As has been described above, the paper P is conveyed in the state in which the image recording face is faced to the inside of the chain gripper 66 for the varnish post-treatment. Because of this, the heat unit 71 is arranged in the inside of the chain gripper 66 for the varnish post-treatment. When the heat unit 71 is structured of the heater and the blowing device, the heat unit 71 can control its heat intensity by the number of lit heaters and the lighting duty.

The varnish curing unit 24B performs a treatment of irradiating the surface of the image of the paper P which is conveyed by the chain gripper 66 for the varnish post-treatment, with UV light, and UV-curing the varnish. Because of this, the varnish curing unit 24B is structured of a UV-irradiation device 73 which is provided with the source of UV light. This UV-irradiation device 73 is also arranged in the inside of the chain gripper 66 for the varnish post-treatment.

The paper P is conveyed by the chain gripper 66 for the varnish post-treatment, and thereby firstly passes through the heating unit 24A before the curing of the varnish. When the applied varnish is heated, the surface of the image is heated when the paper P passes through this heating unit 24A before the curing of the varnish. The paper P which has passed through the heating unit 24A before the curing of the varnish subsequently passes through the varnish curing unit 24B. When the paper P passes through the varnish curing unit 24B, the image recording face is irradiated with UV light. Thereby, the varnish is cured, and the varnish is fixed on the image.

<Paper Ejection Portion>

The paper ejection portion 26 performs a treatment of collecting the paper P which has been subjected to a series of treatments. The paper ejection portion 26 is structured of a paper ejection table 76 which stacks the paper P thereon and collects the paper P.

The chain gripper 66 for the varnish post-treatment releases the paper P on the paper ejection table 76, and stacks the paper P on the paper ejection table 76. The paper ejection table 76 is provided with a paper abutment (front paper abutment, rear paper abutment, horizontal paper abutment, and the like) so that the paper P is orderly stacked. In addition, the paper ejection table 76 is provided so as to be capable of moving up and down by an unillustrated paper ejection table elevating device. The paper ejection table elevating device is controlled so as to be driven in synchronization with an increase and a decrease in the paper P to be stacked on the paper ejection table 76, and moves the paper ejection table 76 up and down so that the paper P positioned in the highest place is always positioned at a fixed height.

<<Description of Control System for Image Recording Apparatus>>

Figure 2:
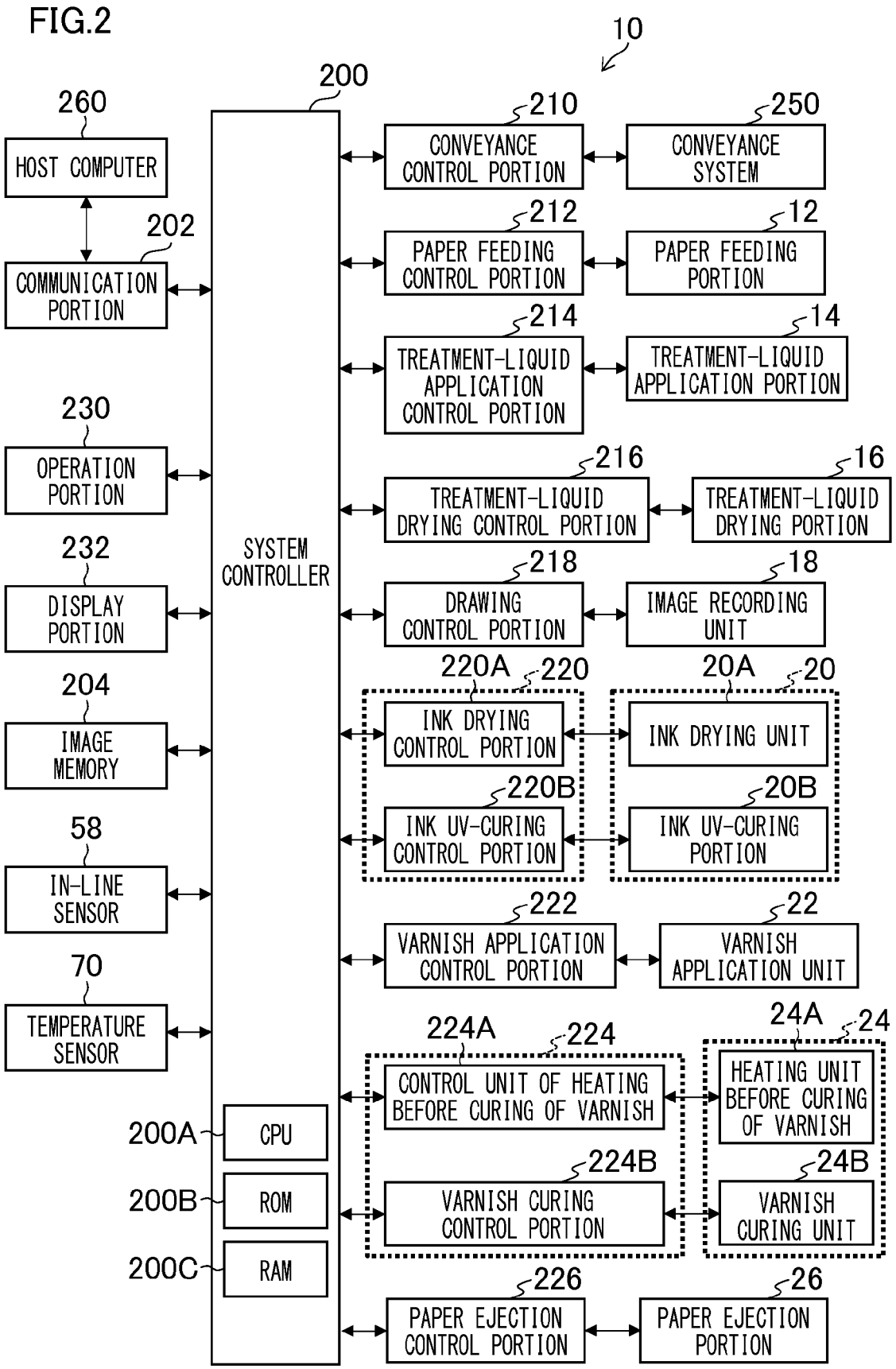
FIG. 2 is a block diagram showing a schematic configuration of a control system of the image recording apparatus.

FIG. 2 is a block diagram showing a schematic configuration of a control system of the image recording apparatus.

As is shown in FIG. 2, the image recording apparatus 10 includes: a system controller 200; a communication portion 202; an image memory 204; a conveyance control portion 210; a paper feeding control portion 212; a treatment-liquid application control portion 214; a treatment-liquid drying control portion 216; an image recording control portion 218; an image post-treatment control portion 220; a varnish application control portion 222; a varnish post-treatment control portion 224; a paper ejection control portion 226; an operation portion 230; and a display portion 232.

The system controller 200 functions as a control device which generally controls each unit and portion of the image recording apparatus 10, and also functions as a calculation device which performs various arithmetic processes. This system controller 200 has a CPU (Central Processing Unit) 200A, a ROM (Read Only Memory) 200B, and a RAM (Random Access Memory) 200C therein.

The communication portion 202 is provided with a necessary communication interface, and transmits and receives data between the communication interface and a host computer 260 which is connected to the communication interface.

The image memory 204 functions as a temporary memory device of various data including image data, and reads and writes data through the system controller 200. The image data which has been taken in from the host computer 260 through the communication portion 202 is stored in the image memory 204 once.

The conveyance control portion 210 controls an operation of a conveyance system 250 of the paper P (conveyance of paper P from paper feeding portion 12 to paper ejection portion 26) in the image recording apparatus 10. The conveyance system 250 includes: the paper feeding drum 38 of the paper feeding portion 12; the treatment liquid drum 42 of the treatment-liquid application portion 14; the treatment-liquid drying drum 46 of the treatment-liquid drying portion 16; the image recording drum 52 of the image recording unit 18; the chain gripper 64 for the image post-treatment of the image post-treatment unit 20; the varnish drum 65 of the varnish application unit 22; and the chain gripper 66 for the varnish post-treatment of the varnish post-treatment unit 24, which have been described in FIG. 1 (see FIG. 1).

The paper feeding control portion 212 controls the operation of the paper feeding portion 12, according to a command sent from the system controller 200. Specifically, the paper feeding control portion 212 controls the operation of the paper feeding portion 12 so that the paper P is fed at a directed paper-feeding speed.

The treatment-liquid application control portion 214 controls the operation of the treatment-liquid application portion 14, according to a command sent from the system controller 200. Specifically, the treatment-liquid application control portion 214 controls the treatment-liquid application device 44 so that the treatment liquid is applied onto the paper P so as to become a directed application amount (application thickness), in synchronization with the passage of the paper P.

The treatment-liquid drying control portion 216 controls the operation of the treatment-liquid drying portion 16, according to a command sent from the system controller 200. Specifically, the treatment-liquid drying control portion 216 controls the operation of the treatment liquid drier 50 so that the surface of the image is heated with directed heat intensity.

The image recording control portion 218 controls the operation of the image recording unit 18, according to a command sent from the system controller 200. Specifically, the image recording control portion 218 controls the ejection of the ink droplets to be ejected by the ink jet heads 56C, 56M, 56Y and 56K so that a directed image is recorded, in synchronization with the passage of the paper P. The image recording control portion 218 controls an operation of the in-line sensor 58 which reads the image, in synchronization with the passage of the paper P.

The image post-treatment control portion 220 includes an ink drying control portion 220A which controls an operation of the ink drying unit 20A, and an ink UV-curing control portion 220B which controls an operation of the ink UV-curing portion 20B.

The ink drying control portion 220A controls an operation of the ink drying unit 20A, according to a command sent from the system controller 200. Specifically, the ink drying control portion 220A controls an operation of the ink drier 68 so that the surface of the image of the paper P to be conveyed is heated with directed heat intensity. As has been described above, when the ink drier 68 is structured of the heater and the blowing device, the ink drier 68 can control its heat intensity by the number of lit heaters and the lighting duty. The heat intensity can be set with the use of parameters of paper thickness (thickness in paper), a paper type (type of paper), an amount of the ink of an image (total amount of ink of image recorded on paper), and a type of surface recording/rear face recording. Incidentally, the information of the parameter may be configured so as to be input from the operation portion 230 by a user, or may also be configured so as to be automatically acquired. Generally, the information is input prior to the image recording, as information necessary to record the image. In addition, the amount of the ink of the image can be determined from the information on the image data to be recorded.

The ink UV-curing control portion 220B controls an operation of the ink UV-curing portion 20B, according to a command sent from the system controller 200. Specifically, the ink UV-curing control portion 220B controls an operation of the UV-irradiation device 69 so that the surface of the image is irradiated with the directed light quantity of UV light, in synchronization with the passage of the paper P.

The varnish application control portion 222 controls an operation of the varnish application unit 22, according to a command sent from the system controller 200. Specifically, the varnish application control portion 222 controls an operation of the varnish applying unit 80 so that the directed application amount of the varnish is applied onto the surface of the image, in synchronization with the passage of the paper P.

The varnish post-treatment control portion 224 includes a control unit 224A of heating before the curing of the varnish, which controls an operation of the heating unit 24A before the curing of the varnish, and a varnish curing control portion 224B which controls an operation of the varnish curing unit 24B.

The control unit 224A of heating before the curing of the varnish controls an operation of the heating unit 24A before the curing of the varnish, on the basis of information sent from the system controller 200. As has been described above, the heating of the varnish by the heating unit 24A before the curing of the varnish is performed when the surface of the image has been heated to the melting point of the wax component or higher in the ink drying unit 20A, in the case where the image has been recorded with the use of the wax containing ink. The control unit 224A of heating before the curing of the varnish acquires information on the attained temperature of the surface of the image when the ink has been dried (attained temperature T1 when the ink has been dried), and information on the melting point TW of the wax component contained in the ink, and controls the operation of the heating unit 24A before the curing of the varnish, on the basis of the obtained information. Specifically, the control unit 224A of heating before the curing of the varnish compares the attained temperature T1 when the ink has been dried with the melting point TW of the wax component, determines whether T1≥TW holds or not, and when T1≥TW holds, makes the heat unit 71 operate and heat the surface of the image. (The heat unit 71 heats surface of image before applied varnish is cured.) At this time, it is preferable that the control unit 224A of heating before the curing of the varnish sets the heat intensity of the heat unit 71 so that the temperature of the heated surface of the image becomes the melting point of the wax component or higher (so that the temperature reaches melting point of wax component at lowest), and makes the heating unit 24A before the curing of the varnish heat the surface of the image.

The varnish curing control portion 224B controls the operation of the varnish curing unit 24B, according to a command sent from the system controller 200. Specifically, the varnish curing control portion 224B controls the operation of the UV-irradiation device 73 so that the surface of the image is irradiated with a directed light quantity of UV light, in synchronization with the passage of the paper P.

The paper ejection control portion 226 controls an operation of the paper ejection portion 26, according to a command sent from the system controller 200.

The operation portion 230 is provided with an operation member such as an operation button, a keyboard and a touch panel, and sends out the operation information which has been input from the operation member to the system controller 200. The system controller 200 performs various processes according to the operation information which has been sent out from this operation portion 230.

The display portion 232 is provided with a display device such as an LCD panel, and makes the display device display information such as various set information and information on abnormality of the device, according to a command sent from the system controller 200.

The information on the image which has been read out by the in-line sensor 58 is memorized in a memory (for instance, RAM 200C) which has been determined beforehand, through the system controller 200.

The information on the temperature which is detected by the temperature sensor 70 is memorized in the memory (for instance, RAM 200C) that has been determined beforehand, through the system controller 200, as the attained temperature T1 when the ink has been dried. Accordingly, in the image recording apparatus 10 of the present embodiment, the temperature sensor 70 functions as the unit of acquiring the information on the attained temperature when the ink has been dried.

Incidentally, in the image recording apparatus 10 of the present embodiment, when the ink containing the wax component is used, a user inputs the information on the melting point of the wax component into the operation portion 230. Accordingly, in the image recording apparatus 10 of the present embodiment, the operation portion 230 functions as the unit for acquiring the information on the melting point. The information on the melting point TW of the wax component, which has been input from the operation portion 230, is memorized in the memory (for instance, RAM 200C) that has been determined beforehand, through the system controller 200.

<<Image Recording Method>>

Figure 3:
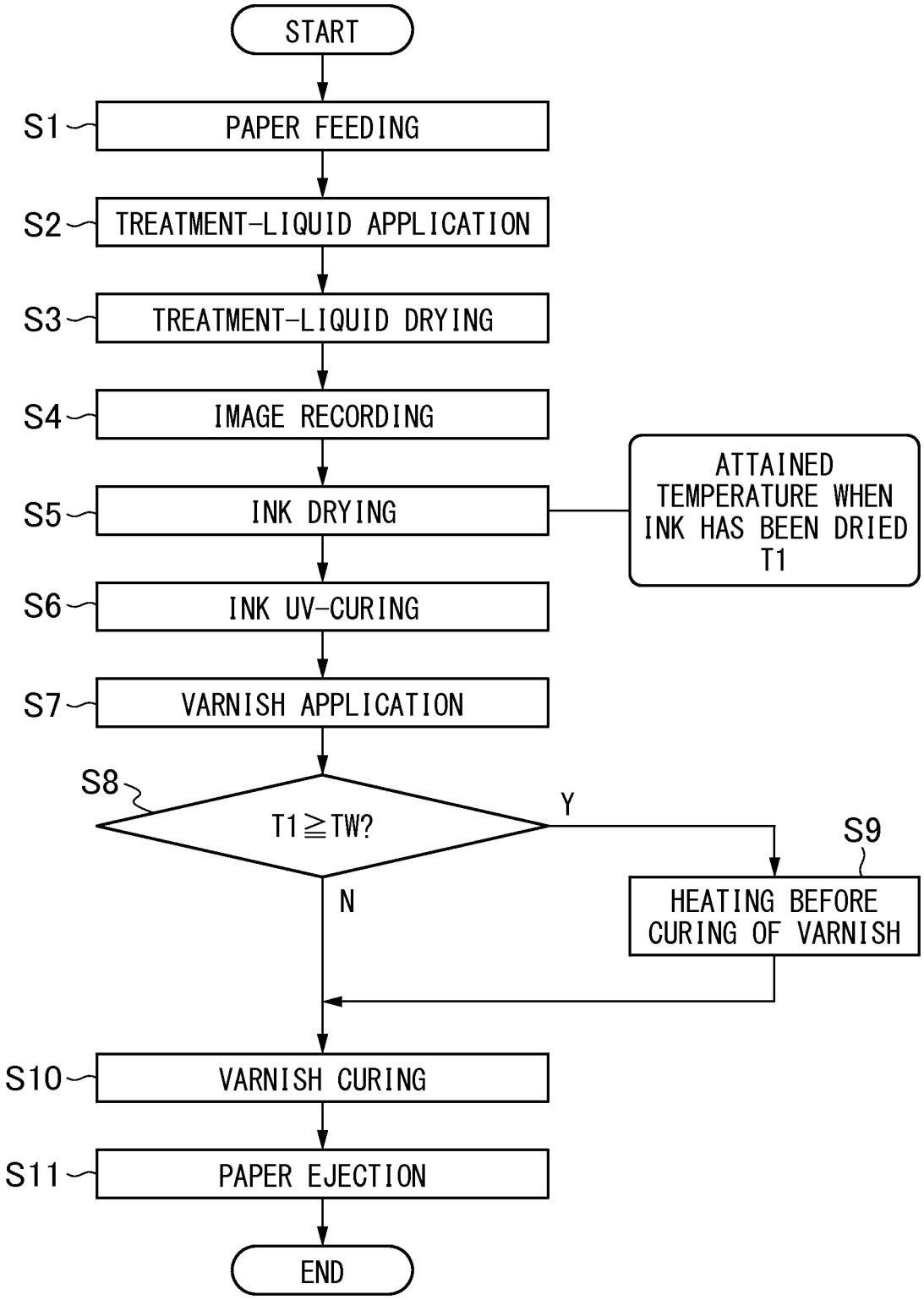
FIG. 3 is a flow chart showing a flow of a series of processes from paper feeding to paper ejection, in the image recording apparatus.

FIG. 3 is a flow chart showing a flow of a series of treatments from paper feeding to paper ejection, in the image recording apparatus of the present embodiment.

Incidentally, here, the image recording method will be described below by taking the case as an example, where an aqueous UV ink containing a wax component is used as the ink. In this case, a user inputs the information on the melting point TW of the wax component from the operation portion 230. The input information is stored in the memory of the system controller 200, and is output to the control unit 224A of heating before the curing of the varnish.

Firstly, the paper feeding portion 12 feeds the paper P (step S1: paper feeding step).

The fed paper P is conveyed to the treatment-liquid application portion 14, and the treatment liquid is applied onto the image recording face (step S2: treatment-liquid application step).

The paper P on which the treatment liquid has been applied is conveyed to the treatment-liquid drying portion 16, and the applied treatment liquid is dried (step S3: treatment-liquid drying step).

The paper P on which the treatment liquid has been dried is conveyed to the image recording unit 18, and the image is recorded on the image recording face (step S4: image recording step). Specifically, the ink droplets which have been ejected from the ink jet heads 56C, 56M, 56Y and 56K, respectively, strike the image recording face, and an image is recorded on the image recording face.

The paper P on which the image has been recorded is conveyed to the image post-treatment unit 20, and the image which has been recorded on the image recording face is subjected to the post treatment. Specifically, firstly, in the ink drying unit 20A, hot air is blown onto the surface of the image, and the ink is dried (step S5: ink drying step). At this time, the temperature of the surface of the image is detected by the temperature sensor 70 as the attained temperature T1 when the ink has been dried, and the information is output to the system controller 200. The system controller 200 outputs the obtained information on the attained temperature T1 when the ink has been dried, to the control unit 224A of heating before the curing of the varnish.

The surface of the image of the paper P on which the ink has been dried is subsequently irradiated with UV light in the ink UV-curing portion 20B, and the ink is cured (step S6: ink UV-curing step).

By the above steps, the post treatment of the image is completed which has been recorded on the image recording face.

The paper P of which the image has been subjected to the post treatment is conveyed to the varnish application unit 22, and the varnish (UV varnish) is applied onto the surface of the image (step S7: varnish application step).

The paper P onto which the varnish has been applied is conveyed to the varnish post-treatment unit 24, and the applied varnish is subjected to the post treatment.

Here, the post treatment for the varnish is UV-curing for the varnish, but in the case where the surface of the image has been heated to the melting point of the wax component or higher when the ink has been dried (step S5), the surface of the image is heated before the varnish is cured (before UV-irradiation), and then the varnish is UV-cured. Specifically, the presence or absence of heating is determined in the next step, and the surface of the image is subjected to heating.

The information on the melting point TW of the wax component contained in the ink is input from the operation portion 230 beforehand, and is transmitted to the control unit 224A of heating before the curing of the varnish. In addition, the information on the attained temperature T1 when the ink has been dried is sent to the control unit 224A of heating before the curing of the varnish, through the system controller 200. The control unit 224A of heating before the curing of the varnish compares the acquired attained temperature T1 when the ink has been dried with the melting point TW of the wax component, and determines whether T1≥TW holds or not (step S8: determining step). Then, when T1≥TW holds, the control unit 224A of heating before the curing of the varnish makes the heat unit 71 operate and heat the surface of the image (step S9: heating step before curing of varnish). At this time, it is preferable that the control unit 224A of heating before the curing of the varnish makes the heat unit 71 operate and heat the surface of the image so that the temperature of the surface of the image becomes the melting point of the wax component or higher. On the other hand, when T1<TW holds, the control unit 224A of heating before the curing of the varnish does not make the heat unit 71 operate, and makes the paper P pass therethrough.

Thus, the control unit 224A determines whether the surface of the image has been heated to the melting point of the wax component or higher when the ink has been dried (step S6); when the surface of the image has been heated to the temperature (T1≥TW holds), makes the heating unit 24A before the curing of the varnish heat the surface of the image before the varnish is cured (before UV-irradiation) (step S9); and when the surface of the image is not heated to the temperature (T1<TW holds), makes the heating unit 24A before the curing of the varnish not to heat the surface of the image, and makes the paper P pass therethrough.

The paper P which has passed through the heating unit 24A before the curing of the varnish is conveyed to the varnish curing unit 24B, the surface of the image is irradiated with UV light there, and the varnish is cured (step S10: varnish curing step).

After this, the paper P is conveyed to the paper ejection portion 26, and is ejected onto the paper ejection table 76 (step S11: paper ejection step).

Thus, in the image recording apparatus 10 of the present embodiment, in the case where the surface of the image has been heated to the melting point of the wax component or higher when the ink has been dried, the varnish is heated and then cured after the varnish has been applied. Thereby, the adhesiveness of the varnish can be enhanced. The enhancement is caused by the following mechanism. Specifically, when the surface of the image is heated to the melting point of the wax component or higher, the wax component results in being nonuniformly distributed on the surface of the ink layer. (The wax component which is nonuniformly distributed on the surface of the ink layer becomes a cause of lowering the adhesiveness of the varnish.) However, when the surface of the image is heated after the varnish has been applied and before the varnish is cured, and the applied varnish is consequently heated, the wax component which has been nonuniformly distributed on the surface of the ink layer can be thereby dissolved into the varnish layer again, and the wax component which has been nonuniformly distributed on the surface of the ink layer can be removed. Thereby, the adhesiveness of the varnish can be enhanced. In particular, when the surface of the image is heated so that the temperature of the surface of the image becomes the melting point of the wax component or higher, after the varnish has been applied, the diffusion of the wax component which has been nonuniformly distributed on the surface of the image into the varnish layer can be thereby accelerated, and the wax component which has been nonuniformly distributed on the surface of the ink layer can be more efficiently removed.

Modified Example

Method for Acquiring Attained Temperature T1 when Ink has been Dried

As has been described above, when the ink drier 68 is structured of the heater and the blowing device, the ink drier 68 can control its heat intensity by the number of lit heaters and the lighting duty. It is preferable that the heat intensity is set with the use of information on at least one, for instance, of a paper thickness (thickness in paper), a paper type (type of paper), the amount of the ink of the image (total amount of ink of image to be recorded on paper), and a type of surface recording/rear face recording, as a parameter. Specifically, a heating value necessary for drying varies depending on the paper thickness, the paper type, the amount of the ink of the image, and the type of the surface recording/rear face recording, and accordingly it is preferable that the heat intensity of the ink drier 68 is set with the use of the information. Thereby, the ink can be appropriately dried.

On the other hand, in the case where the heat intensity of the ink drier 68 is set with the use of such information, if the information on the parameter used in the setting is used, the attained temperature T1 when the ink has been dried can be accurately estimated to some extent. Accordingly, when the heat intensity of the ink drier 68 of the ink drying unit 20A is set by using at least one of the paper thickness, the paper type, the amount of the ink of the image and the type of the surface recording/rear face recording, as a parameter, such a configuration can also be adopted that the parameter used in the setting as the parameter for estimating the attained temperature when the ink has been dried is acquired, and the attained temperature T1 when the ink has been dried is estimated and acquired. Thereby, even though the temperature sensor 70 is not provided on the ink drying unit 20A, the unit of acquiring the information on the attained temperature when the ink has been dried can acquire the information on the attained temperature T1 when the ink has been dried.

Incidentally, in this case, the system controller 200 acquires the parameter for estimating the attained temperature when the ink has been dried, and the system controller 200 also performs the estimating process. Accordingly, the system controller 200 functions as the unit for acquiring the parameter for estimating the attained temperature when the ink has been dried, and the unit for estimating the attained temperature when the ink has been dried.

The estimating process can be configured so as to prepare a table beforehand in which the relationship between the parameter for estimating the attained temperature when the ink has been dried and the attained temperature T1 when the ink has been dried is specified, as a table for estimating the attained temperature when the ink has been dried, and to estimate the attained temperature T1 when the ink has been dried, with reference to the prepared table for estimating the attained temperature when the ink has been dried. The table for estimating the attained temperature when the ink has been dried is prepared by experiment or simulation.

Thus, the information on the attained temperature T1 when the ink has been dried can be acquired even without using the temperature sensor 70, by estimating the attained temperature T1 when the ink has been dried, by using the parameter for estimating the attained temperature when the ink has been dried.

<Method for Setting Heat Intensity in Heating Unit Before Curing of Varnish>

As has been described above, when the surface of the image has been heated to the melting point of the wax component or higher when the ink has been dried, the surface of the image is heated before the varnish is cured. In this case, the surface of the image is heated so that the temperature of the surface of the image becomes the melting point of the wax component or higher, and thereby the adhesiveness of the varnish can be further enhanced.

However, when the image quality is lowered by heating, it is preferable to limit the heating temperature. For instance, when problems such as a deformation (cockle and wrinkle) of the paper, and the abnormality of a surface condition, cloudiness and stickiness of the varnish application face arise due to heating, it is preferable to limit the heating temperature.

Accordingly, when the surface of the image is heated prior to the curing of the varnish, the upper limit of the temperature should be set at a temperature at which these problems do not arise. Specifically, the heating unit 24A before the curing of the varnish heats the surface of the image after its heat intensity has been set so that these problems do not arise.

In addition, as has been described above, the attained temperature T1 when the ink has been dried can be estimated with the use of the parameter for estimating the attained temperature when the ink has been dried, and accordingly the heat intensity of the heating unit 24A before the curing of the varnish can be set with the use of this estimated information on the attained temperature T1 when the ink has been dried. In this case, such a configuration can also be adopted that a table in which the relationship beforehand between the parameter for estimating the attained temperature when the ink has been dried and drying intensity to be set is specified is prepared, and that the drying intensity to be set with reference to the table is directly determined In addition to the configuration, the control unit 224A of heating before the curing of the varnish can also be configured so as to provide a temperature sensor (for instance, radiation thermometer) which measures the temperature of the surface of the image provided in the heating unit before the curing of the varnish, so as to feed back the output from this temperature sensor, and so as to control the heat intensity. The control unit 224A of heating before the curing of the varnish can also control, for instance, the heat intensity so that the temperature of the heated surface of the image becomes the melting point TW of the wax.

<<Structure of Varnish Application Device of Discrete Device>>

In the above described embodiment, the varnish application device is structured so as to be incorporated into the image recording apparatus and apply the varnish in a line (in-line varnish coating), but the varnish application device can also be structured so as to be a discrete device (off-line varnish coating) which is separate from the image recording apparatus.

Figure 4:
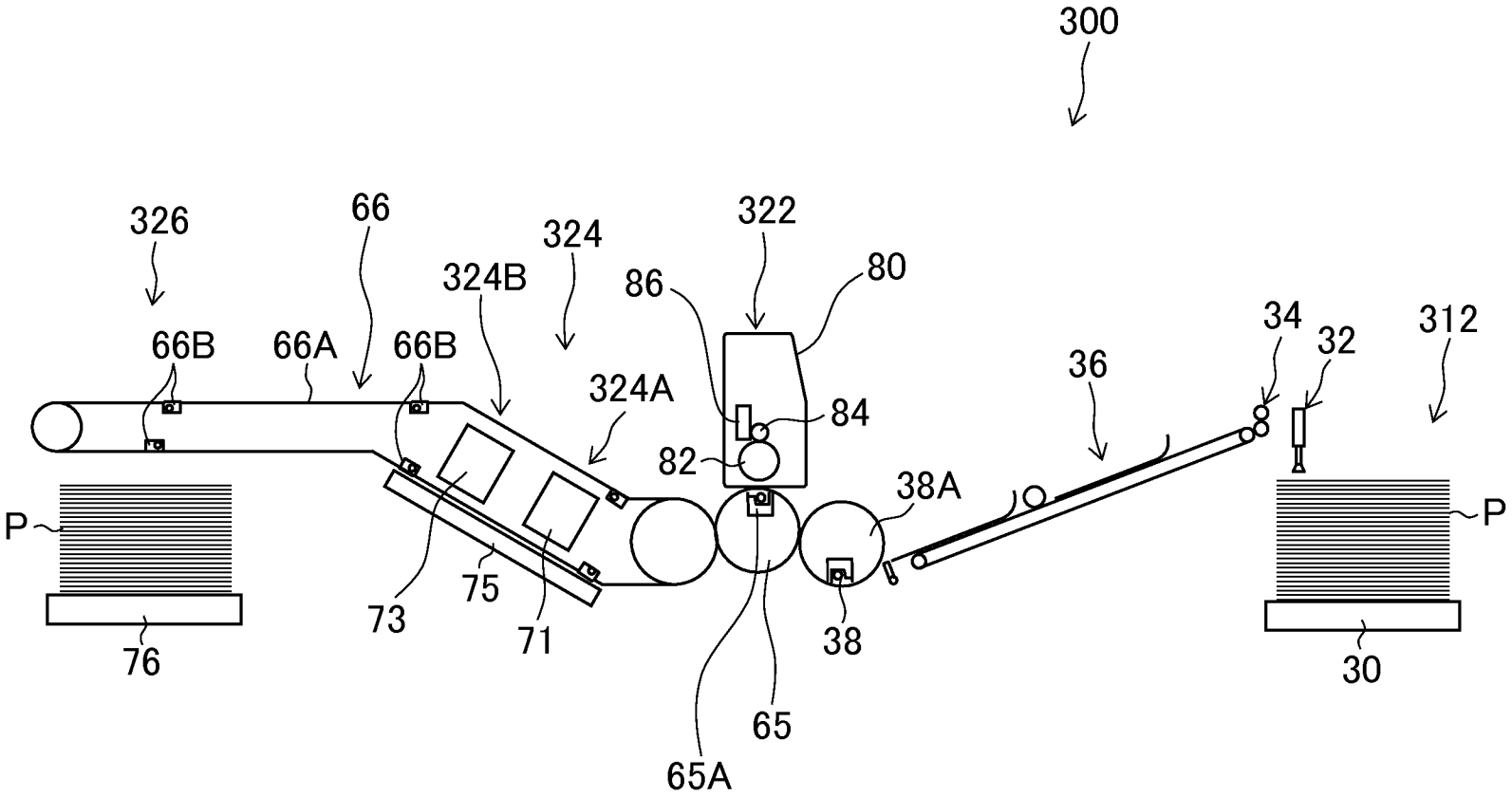
FIG. 4 is a whole schematic diagram showing one embodiment of a varnish application device.

FIG. 4 is a whole schematic diagram showing one embodiment of the varnish application device.

This varnish application device 300 includes: a paper feeding portion 312 which feeds the paper P; a varnish application unit 322 which applies a varnish onto the paper P; a varnish post-treatment unit 324 which subjects the applied varnish to post treatment; and a paper ejection portion 326 which ejects the paper P. The paper feeding portion 312 has the same structure as that of the above described paper feeding portion 12 in the image recording apparatus 10; and the varnish application unit 322, the varnish post-treatment unit 324 and the paper ejection portion 326 have also the same structures as those of the above described varnish application unit 22, varnish post-treatment unit 24 and paper ejection portion 26 in the image recording apparatus 10, respectively. Accordingly, the elements which constitute the respective units and portions are denoted by the same reference numerals, and the description is omitted.

In the varnish application device 300 of the present embodiment, the paper P is directly fed to the varnish application unit 322 from the paper feeding portion 312. The varnish is applied to the fed paper P in the varnish application unit 322; and the resultant paper is subsequently subjected to a predetermined post treatment in the varnish post-treatment unit 324, and is ejected onto the paper ejection portion 326.

The varnish post-treatment unit 324 is provided with a heating unit 324A before the curing of the varnish, which subjects the paper P to the heating treatment before the curing of the varnish, and a varnish curing unit 324B which subjects the paper P to the varnish curing treatment; and subjects the paper P to the heating treatment prior to the curing treatment of the varnish (heating treatment before curing of varnish), under a fixed condition. Specifically, only in the case where the paper P of which the surface of the image has been heated to the melting point of the wax component or higher when the ink has been dried is subjected to the treatment, the surface of the image is heated by the heating unit 324A before the curing of the varnish. Thereby, the adhesiveness of the applied varnish can be enhanced.

Figure 5:
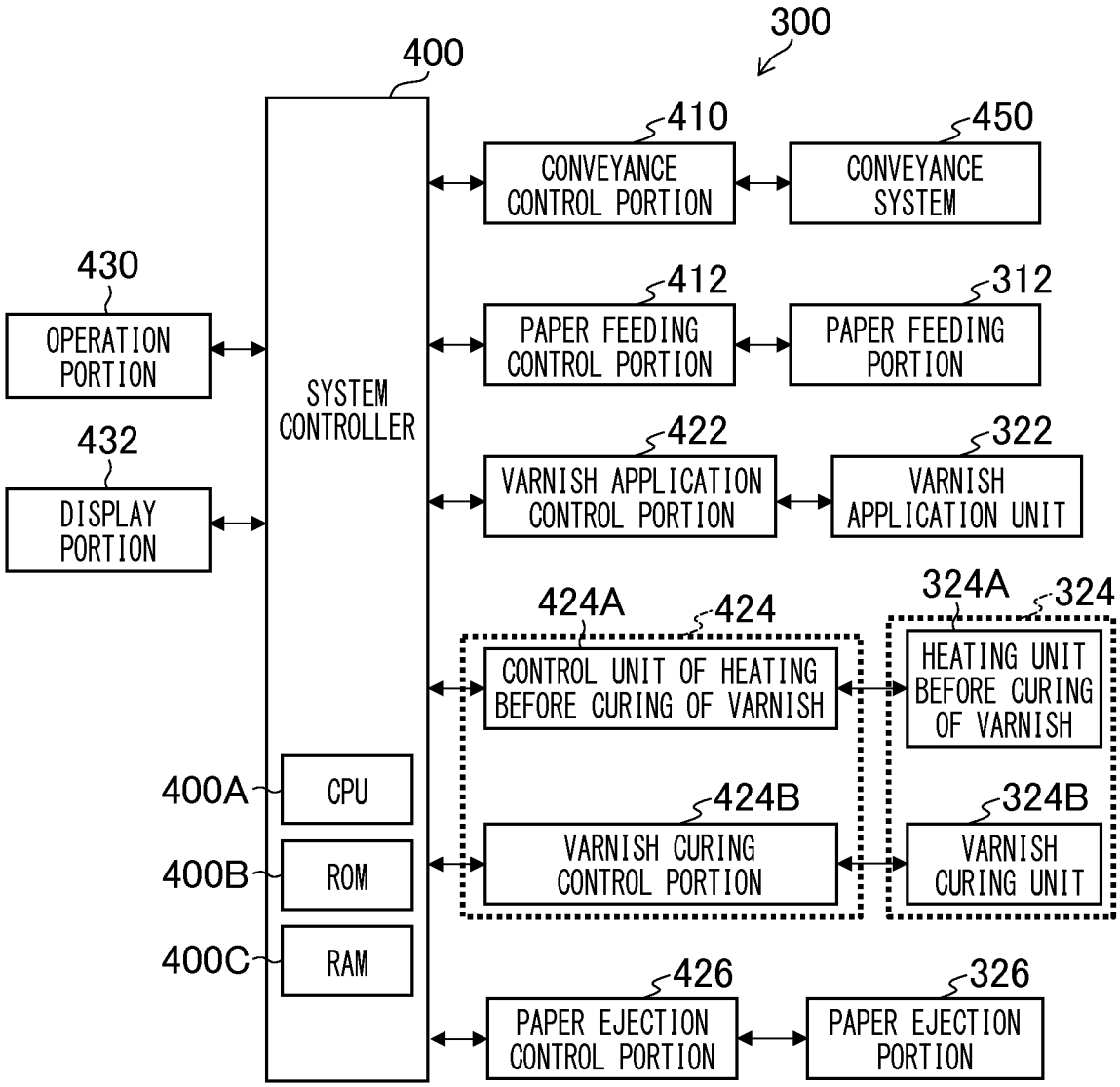
FIG. 5 is a block diagram showing a schematic configuration of a control system of the varnish application device.

FIG. 5 is a block diagram showing a schematic configuration of a control system of the varnish application device.

As is shown in FIG. 5, the varnish application device 300 includes: a system controller 400; a conveyance control portion 410; a paper feeding control portion 412; a varnish application control portion 422; a varnish post-treatment control portion 424; a paper ejection control portion 426; an operation portion 430; and a display portion 432.

The system controller 400 functions as a control device which generally controls each portion of the varnish application device 300, and also functions as a calculation device which performs various arithmetic processes. This system controller 400 has a CPU 400A, a ROM 400B and a RAM 400C built therein.

The conveyance control portion 410 controls an operation of a conveyance system 450 of the paper P (conveyance of paper P from paper feeding portion 312 to paper ejection portion 326) in the varnish application device 300. The conveyance system 450 includes a paper feeding drum 38 of the paper feeding portion 312, a varnish drum 65 of the varnish application unit 322, and a chain gripper 66 for the varnish post-treatment of the varnish post-treatment unit 324, all of which are described in FIG. 4.

The paper feeding control portion 412 controls the operation of the paper feeding portion 312, according to a command sent from the system controller 400. Specifically, the paper feeding control portion 412 controls the operation of the paper feeding portion 312 so that the paper P is fed according to a directed paper feeding procedure.

The varnish application control portion 422 controls the operation of the varnish application unit 322, according to a command sent from the system controller 400. Specifically, the varnish application control portion 422 controls an operation of the varnish applying unit 80 so that the directed application amount of the varnish is applied onto the surface of the image, in synchronization with the passage of the paper P.

The varnish post-treatment control portion 424 includes a control unit 424A of heating before the curing of the varnish, which controls an operation of the heating unit 324A before the curing of the varnish, and a varnish curing control portion 424B which controls an operation of the varnish curing unit 324B.

The control unit 424A of heating before the curing of the varnish controls an operation of the heating unit 324A before the curing of the varnish, on the basis of information sent from the system controller 400. The control unit 424A of heating before the curing of the varnish acquires information on the attained temperature of the surface of the image when the ink has been dried (attained temperature T1 when ink has been dried), and information on the melting point TW of the wax component contained in the ink; and controls the operation of the heating unit 24A before the curing of the varnish, on the basis of the obtained information. Specifically, the control unit 424A of heating before the curing of the varnish compares the attained temperature T1 when the ink has been dried with the melting point TW of the wax component, determines whether T1≥TW holds or not, and when T1≥TW holds, makes the heat unit 71 operate and heat the surface of the image. (The heat unit 71 heats surface of image before applied varnish is cured.)

The varnish curing control portion 424B controls an operation of the varnish curing unit 324B, according to a command sent from the system controller 400. Specifically, the varnish curing control portion 424B controls the operation of the UV-irradiation device 73 so that the surface of the image is irradiated with a directed light quantity of UV light, in synchronization with the passage of the paper P.

The paper ejection control portion 426 controls an operation of the paper ejection portion 326, according to a command sent from the system controller 400.

The operation portion 430 is provided with an operation member such as an operation button, a keyboard and a touch panel, and sends out the operation information which has been input from the operation member thereof to the system controller 400. The system controller 400 performs various processes according to the operation information which has been sent out from this operation portion 430.

The display portion 432 is provided with a display device such as an LCD panel, and makes the display device display information such as various set information and information on abnormality of the device, according to a command sent from the system controller 400.

Incidentally, a user inputs the information on the melting point of the wax component, into the operation portion 430. Accordingly, in the varnish application device 300 of the present embodiment, the operation portion 430 functions as a unit for acquiring the information on the melting point. The information on the melting point TW of the wax component, which has been input from the operation portion 430, is memorized in a memory (for instance, RAM 400C) through the system controller 400. The control unit 424A of heating before the curing of the varnish reads out the information which has been recorded in this memory, and determines whether the heating before the curing of the varnish is necessary or not.

The user inputs also the information on the attained temperature T1 when the ink has been dried, into the operation portion 430. Accordingly, in the varnish application device 300 of the present embodiment, the operation portion 430 functions as a unit of acquiring the information on the attained temperature when the ink has been dried. The information on the attained temperature T1 when the ink has been dried, which has been input from the operation portion 430, is memorized in the memory (for instance, RAM 400C) through the system controller 400. The control unit 424A of heating before the curing of the varnish reads out the information which has been recorded in this memory, and determines whether the heating before the curing of the varnish is necessary or not.

Incidentally, when the control unit 424A of heating before the curing of the varnish has set the heat intensity of the drying device by using at least one of the paper thickness, the paper type, the amount of the ink of the image, and the type of the surface recording/rear face recording, as a parameter, and has performed a treatment of drying the ink, such a configuration can also be adopted that the unit for acquiring the parameter for estimating the attained temperature when the ink has been dried acquires the parameter used in the setting as the parameter for estimating the attained temperature when the ink has been dried, the unit for estimating the attained temperature when the ink has been dried estimates the attained temperature T1 when the ink has been dried, and the unit of acquiring the information on the attained temperature when the ink has been dried acquires the attained temperature T1 when the ink has been dried. In this case, the system controller 400 acquires the parameter for estimating the attained temperature when the ink has been dried, and the system controller 400 also performs the estimating process. Accordingly, the system controller 400 functions as the unit for acquiring the parameter for estimating the attained temperature when the ink has been dried, and the unit for estimating the attained temperature when the ink has been dried.

The estimating process can be configured so as to prepare a table beforehand in which the relationship between the parameter for estimating the attained temperature when the ink has been dried and the attained temperature T1 when the ink has been dried is specified, as a table for estimating the attained temperature when the ink has been dried, and so as to estimate the attained temperature T1 when the ink has been dried, with reference to the prepared table for estimating the attained temperature when the ink has been dried. The table for estimating the attained temperature when the ink has been dried is prepared by experiment or simulation.

<<Varnish Application Method>>

Figure 6:
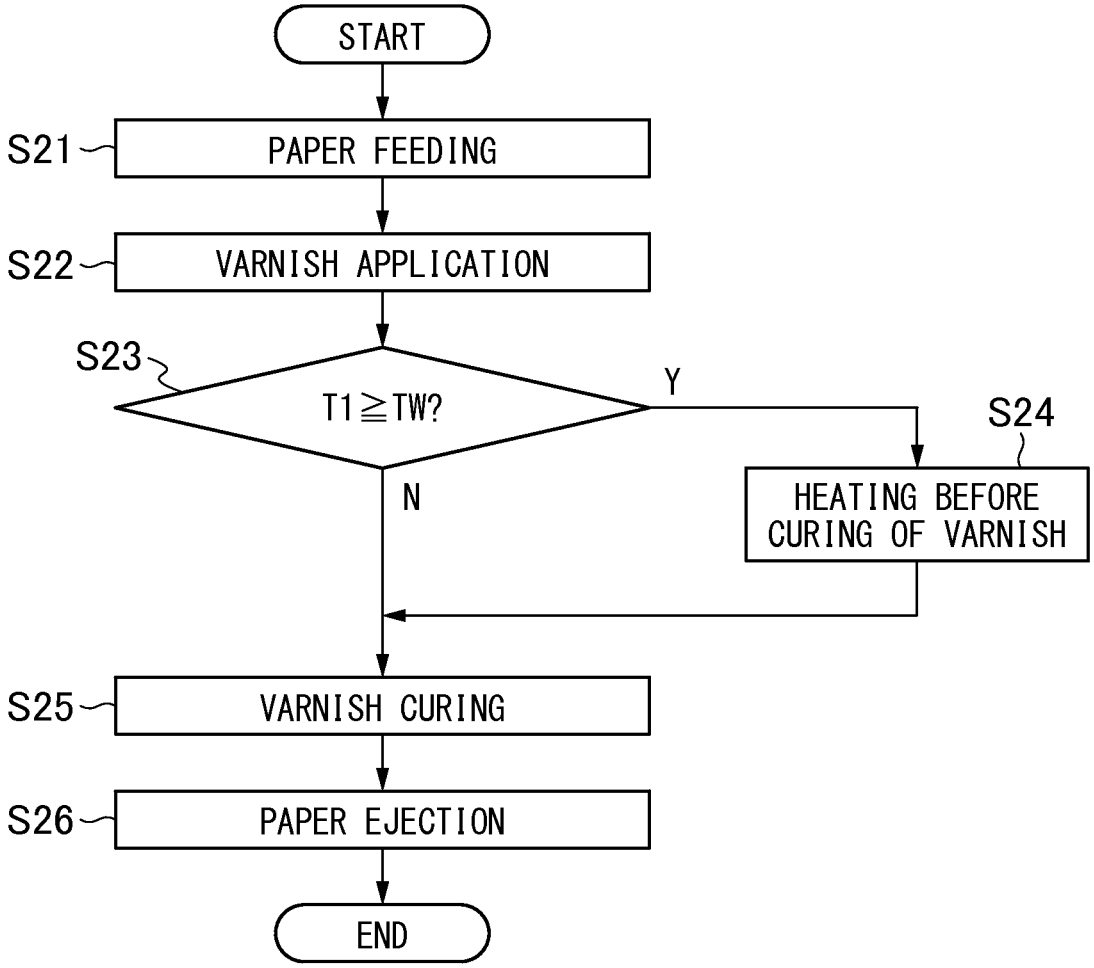
FIG. 6 is a flow chart showing a flow of a series of processes from paper feeding to paper ejection by the varnish application device.

FIG. 6 is a flow chart showing a flow of a series of processes from paper feeding to paper ejection, in the varnish application device of the present embodiment.

Incidentally, the paper (medium) of an object to be treated shall be the paper on which the image has been recorded with the use of the ink containing the wax component, and after the recording, the surface of the image is heated and dried.

In addition, the treatment shall be started on the precondition that the information on the melting point TW of the wax component and the information on the attained temperature T1 when the ink has been dried have been input into the varnish application device 300.

Firstly, the paper feeding portion 12 feeds the paper P (step S21: paper feeding step).

The fed paper P is conveyed to the varnish application unit 322, and the varnish (UV varnish) is applied onto the surface of the image (step S22: varnish application step).

The paper P onto which the varnish has been applied is conveyed to the varnish post-treatment unit 324, and the applied varnish is subjected to the post treatment.

The post treatment of the varnish is UV curing of the varnish, but when the surface of the image of the paper P which is the object to be treated has been heated to the melting point of the wax component or higher when the ink has been dried, the surface of the image is heated prior to the curing (prior to UV-irradiation).

The control unit 424A of heating before the curing of the varnish acquires the information on the attained temperature T1 when the ink has been dried and the information on the melting point TW of the wax component, compares both, and determines whether T1≥TW holds or not (step S23: determining step). Then, when T1≥TW holds, the control unit 424A of heating before the curing of the varnish makes the heat unit 71 operate and heat the surface of the image (step S24: heating step before curing of varnish). At this time, the control unit 424A of heating before the curing of the varnish makes the heat unit 71 operate and heat the surface of the image so that the temperature of the surface of the image becomes the melting point of the wax component or higher. On the other hand, when T1<TW holds, the control unit 424A of heating before the curing of the varnish does not make the heat unit 71 operate, and makes the paper P pass therethrough.

The paper P which has passed through the heating unit 324A before the curing of the varnish is conveyed to the varnish curing unit 324B, the surface of the image is irradiated with UV light, and the varnish is cured (step S25: varnish curing step).

After that, the paper P is conveyed to the paper ejection portion 326, and is ejected onto the paper ejection table 76 (step S26: paper ejection step).

Thus, in the varnish application device 300 of the present embodiment, when the surface of the image of the paper P which is the object to be treated has been heated to the melting point of the wax component or higher when the ink has been dried, the surface of the image is heated prior to the curing of the varnish after the varnish has been applied. Thereby, the wax component which has been nonuniformly distributed on the surface of the ink layer can be removed, and the adhesiveness between the ink layer and the varnish layer can be enhanced.

Incidentally, when the surface of the image is heated prior to the curing of the varnish, it is preferable that the surface of the image is heated to the melting point of the wax component or higher. Thereby, the adhesiveness of the varnish can be further enhanced.

In addition, when the image quality is lowered by the heating, it is preferable to limit the heating temperature. For instance, when problems such as a deformation (cockle and wrinkle) of the paper, and the abnormality of a surface condition, cloudiness and stickiness of the varnish application face arise, it is preferable to limit the heating temperature.

Incidentally, when the application treatment of the varnish is independently performed (so-called off-line varnish coating) as in the varnish application device 300 of the present embodiment, the heat intensity can be controlled by changing the conveyance speed of the paper P. Specifically, when it is intended to raise the heat intensity, the conveyance speed of the paper P is lowered, and when it is intended to lower the heat intensity, the conveyance speed of the paper P is raised. Thereby, the heating period of time is changed, and the heat intensity is controlled.

Other Embodiments

Concerning Ink

In the above described image recording apparatus 10, an example has been described which uses the aqueous UV ink, but the type of the ink to be used is not limited in particular, when the present invention is carried out. Accordingly, the ink does not necessarily need to be an ultraviolet curing type of ink, and usual ink can be used. When the usual ink has been employed, the ink UV-curing portion 20B in the image post-treatment unit 20 can be omitted.

<Concerning Wax>

The wax which is contained in the ink can include a natural wax and a synthetic wax.

The natural waxes can include: a paraffin wax, a microcrystalline wax, petrolatum and the like which are petroleum waxes; a carnauba wax, a candelilla wax, a rice wax, a Japan wax and the like which are plant-derived waxes; and lanolin, beeswax and the like which are animal/plant-derived waxes.

In addition, the synthetic waxes can include a polyethylene wax, a Fischer-Tropsch wax and the like which are synthetic hydrocarbon-based waxes; and a paraffin wax derivative, a montan wax derivative, a microcrystallin wax derivative and the like which are modified wax-based derivatives.

As for the form of the wax, it is not preferable to employ a solid wax, but is preferable to employ a wax emulsion which shows a liquid form and particularly to employ an aqueous wax emulsion, so as not to use heat energy for image formation from the viewpoint of energy saving. The wax emulsion is also referred to generally as an emulsion wax (emulsifiable wax). The wax emulsion is an emulsion in which fine particles of a solid wax is dispersed in water with the use mainly of a surfactant. For instance, a polyethylene wax emulsion (polyethylene emulsion wax) is formed by: oxidizing a polyethylene wax which has been produced by a production method through the polymerization of ethylene, a production method of converting the molecule of polyethylene for general formation into lower molecular weight by thermal decomposition, or the like; adding a carboxyl group and/or a hydroxyl group to the oxidized polyethylene wax; and further emulsifying the polyethylene wax with the use of a surfactant to convert the polyethylene wax into a form of the aqueous wax emulsion having high stability.

<Concerning Varnish>

A general varnish which is used in the printing field can be used as the varnish. However, in the present invention, the varnish needs to be heated prior to the curing of the varnish, as needed, and accordingly the present invention assumes that an active ray effect type of varnish (varnish cured by irradiation with active rays) is used. The UV varnish is one example of the active ray-curing type of varnish.

For information, the above described image recording apparatus 10 and the varnish application device 300 are provided with a heating unit before the curing of the varnish, and accordingly when an oil varnish or an aqueous varnish is used, the heating unit before the curing of the varnish can be used as a drying device for the varnish.

<Concerning Method for Applying Varnish>

A method for applying the varnish is not limited in particular, and can adopt a spray application method and the like, in addition to the roller application method which has been described in the above described embodiment.

<Concerning Treatment Liquid>

The treatment liquid is appropriately selected according to the ink to be used. The treatment liquid may have a function of agglomerating pigment and/or particles of a self-dispersible polymer in the ink to be used. Incidentally, when the present invention is carried out, the treatment liquid does not necessarily need to be applied. A structure can also be adopted in which the step of applying the treatment liquid is omitted.

<Concerning Medium>

The media include a recording medium, a printing medium, a medium to be recorded, a medium on which an image is formed, an image receiving medium, a medium to be ejected and the like, which are referred to by various terms. When the present invention is carried out, the material, the shape and the like of the printing medium are not limited in particular, and various sheet-shaped bodies can be used regardless of the material and the shape, which include: a sheet of cut paper; paper for a sticker; a resin sheet such as a sheet for OHP (overhead projector); film; cloth; nonwoven cloth; a printed-circuit board on which a wiring pattern or the like is formed; and a rubber sheet. In addition, a structure can also be adopted in which the sheet of paper is used that has been cut from continuous paper.

<Concerning System for Recording Image by Ink Jet Head>

In the above described embodiment, a line system using a line head has been illustrated, but as for the ink jet head, a shuttle system using a serial head (system for recording image while making head scan in width direction of paper) also can be adopted.

<Concerning Device for Relatively Moving Head with Respect to Paper>

In the above described embodiment, the structure has been illustrated in which the paper is conveyed to the stopped ink jet head, but when the present invention is carried out, a structure can also be adopted in which the ink jet head is moved with respect to the stopped paper.

<Concerning Method for Ejecting Ink Droplet by Ink Jet Head>

The device for generating a pressure for ejection (ejection energy) for ejecting a droplet from each nozzle in the ink jet head is not limited to a piezo-actuator (piezoelectric element). In addition to the piezoelectric element, various pressure-generating elements (ejection energy-generating element) can also be applied which include: an electrostatic actuator; a heater (heating element) in a thermal system (system of ejecting ink by using pressure of film boiling caused by heating of heater); and various actuators in other systems. A suitable energy-generating element is provided on a flow channel structure according to an ejection method of the head.

<Concerning System for Drying Ink>

The image recording apparatus 10 of the above described embodiment is structured so that the heating device (ink drier 68) which is structured of the heat source and the blowing device heats the surface of the image and dries the ink, but the structure for heating and drying the ink is not limited to the structure. In addition to this structure, systems can be adopted, for instance, such as a system of heating the surface of the image by radiation originating from the heat source such as a heater to dry the ink, and a system of heating the surface of the image by making hot air blown from a blower hit the surface of the image to dry the ink. In the case of heating by the radiation, the heat intensity can be controlled by the number of lit heaters and the lighting duty. In addition, in the case of the heating by the blower, the heat intensity can be controlled by the temperature of the hot air.

In addition, in the above described embodiment, the image recording apparatus has a structure in which the heating device (ink drier 68) is arranged in the upper side of the paper P to be conveyed to heat the surface of the image of the paper P, but the place in which the heating device for heating the surface of the image of the paper P is arranged is not limited to the upper side of the paper P. The image recording apparatus can also have a structure in which the heating device (ink drier 68) is arranged, for instance, in the side part or the lower part of the conveyance path of the paper P to heat the surface of the image of the paper P.

<Concerning Heating System Before Curing of Varnish>

Concerning the heating system before the curing of the varnish as well, such systems can be adopted as to heat the surface of the image by radiation originating from the heat source of the heater or the like, and as to heat the surface of the image by making hot air blown from the blower hit the surface of the image, similarly to the above described ink drying system.

<Concerning System for Recording Image on Medium>

In the above described embodiment, the case has been described as an example, where the image is recorded on the medium with the ink jet method, but the system for recording the image on the medium is not limited in particular. Any recording system can be widely applied and can show a similar effect, as long as the recording system is a recording system which requires drying by heat after the ink has been applied.

Example

In order to confirm the effect of the present invention, such a test was conducted that the varnish was applied so that the attained temperature when ink was dried and the attained temperature before the varnish was cured (attained temperatures of surface of image in heating unit before curing of varnish) were variously different and the adhesiveness of the applied varnish was evaluated.

<Test 1: Basic Test>

The test was conducted on the following conditions with the use of the image recording apparatus (in-line varnish coating) having the structure of FIG. 1.

Paper: Eye best W (trade name) (made by Nippon Paper Industries Co., Ltd., basis weight: 310 gsm (g/m$^2$), and paper thickness: 0.34 mm)

Ink: black ink (wax content: 2 wt %)

Wax type: Serozoru 524 (trade name) (made by Chukyo Yushi Co., Ltd., and melting point: 83° C.), Amount of ink: 3.0 pL Varnish (UV varnish): TG-2 (trade name) (made by T&K TOKA Co., Ltd.)

The evaluation was performed by the following method.

A cellophane tape (made by Nichiban Co., Ltd., and width: 18 mm) having a length of approximately 40 mm was stuck onto the varnish application face, the stuck tape was pulled in a vertical direction, and the peeled state of the varnish layer was evaluated from the surface of the ink layer.

The state was evaluated according to the following four stages.

| | | |
|---|---|---|
| 4: VERY GOOD | OK | No peeling, or paper is broken |
| 3: GOOD | OK (acceptable) | peeling in dot shape |
| 2: BAD | No good (unacceptable) | partially peeled |
| 1: VERY BAD | No good | wholly peeled |

Incidentally, it was determined that 4 was the best and 3 or more was acceptable.

Table 1 shown in FIG. 7 is a table showing the test result.

Incidentally, in the Table 1, the evaluation result in a colored grid is the evaluation result of the time when the surface of the image was heated prior to the curing of the varnish, and the evaluation result of a grid which is not colored is the evaluation result of the time when the surface of the image was not heated prior to the curing of the varnish. The reason why the attained temperatures before the varnish was cured are different from the attained temperature when the ink has been dried when the surface of the image was not heated prior to the curing of the varnish is, because after the surface of the image was subjected to the ink drying treatment, the temperature was lowered according to the development of the situation.

It can be confirmed from Table 1 that the adequate adhesiveness can be obtained even when the surface of the image is not heated prior to the curing of the varnish, as long as the attained temperature when ink has been dried satisfies the condition of being lower than 83° C. which is the melting point of the wax component. On the other hand, it can be confirmed that the adhesiveness decreases on the condition that the attained temperature when the ink has been dried exceeds 83° C. which is the melting point of the wax component, if the surface of the image is not heated prior to the curing of the varnish. However, it can be confirmed that the adhesiveness can be improved if the surface of the image is heated prior to the curing of the varnish, even on the condition that the attained temperature when the ink has been dried exceeds 83° C. that is the melting point of the wax component. In particular, it can be confirmed that the adhesiveness can be adequately improved when the surface of the image is heated to the melting point of the wax component or higher prior to the curing of the varnish.

<Test 2: Case where Melting Point of Wax has been Changed>

In order to confirm whether difference appears in the effect due to the difference between the melting points of the wax component or not, the same test as the basic test was conducted by using the wax components having different melting points. (The test was conducted on the same condition except for the melting point of the wax component.)

The melting points (wax types) of the wax components which were used in the test are as follows.

(A) Melting point of wax component: 83° C. (same type of wax as that in basic test)

Wax type: Serozoru 524 (trade name) (made by Chukyo Yushi Co., Ltd.)

(B) Melting point of wax component: 55° C.

Wax type: Serozoru 920 (trade name) (made by Chukyo Yushi Co., Ltd.)

(C) Melting point of wax component: 102° C.

Wax type: Hymicron L-271 (trade name) (made by Chukyo Yushi Co., Ltd.)

Incidentally, the melting point of the wax component is a measured value by DSC measurement (differential scanning calorimetry (Differential scanning calorimetry: DSC)).

In FIGS. 8A to 8C, Table 2-1 (FIG. 8A) is a test result of the time when the melting point of the wax component is 83° C.; Table 2-2 (FIG. 8B) is a test result of the time when the melting point of the wax component is 55° C.; and Table 2-3 (FIG. 8C) is a test result of the time when the melting point of the wax component is 102° C.

As shown in Table 2, also when inks each having a different melting point of the wax component are used, the same tendency as the result of the basic test has been shown. Specifically, it can be confirmed that the adequate adhesiveness can be obtained even when the surface of the image is not heated prior to the curing of the varnish, as long as the attained temperature when the ink has been dried satisfies the condition of being lower than the melting point of the wax component. On the other hand, it can be confirmed that the adhesiveness decreases on the condition that the attained temperature when the ink has been dried exceeds the melting point of the wax component, if the surface of the image is not heated prior to the curing of the varnish, but that when the surface of the image is heated prior to the curing of the varnish, the adhesiveness can be improved. In particular, it can be confirmed that the adhesiveness can be adequately improved when the surface of the image is heated to the melting point of the wax component or higher prior to the curing of the varnish.

It has been confirmed from the above described results that a similar effect is obtained also when the melting point of the wax component has been changed.

<Test 3: Case of Off-Line Varnish Coating>

For the purpose of confirming whether a difference between in-line varnish coating and off-line varnish coating appears in the effect or not, a test was conducted.

The same test as the basic test was conducted while using the varnish application device (off-line varnish coating) having the structure shown in FIG. 4, and using wax components each having a different melting point. (The test was conducted on the same condition as that in the basic test except for the off-line coating.)

The melting points of the wax components and the wax types are the same as those in Test 2, and are as follows.

(A) Melting point of wax component: 83° C. (same type of wax as that in basic test)

Wax type: Serozoru 524 (trade name) (made by Chukyo Yushi Co., Ltd.)

(B) Melting point of wax component: 55° C.

Wax type: Serozoru 920 (trade name) (made by Chukyo Yushi Co., Ltd.)

(C) Melting point of wax component: 102° C.

Wax type: Hymicron L-271 (trade name) (made by Chukyo Yushi Co., Ltd.)

In FIGS. 9A to 9C, Table 3-1 (FIG. 9A) is a test result of the time when the melting point of the wax component is 83° C.; Table 3-2 (FIG. 9B) is a test result of the time when the melting point of the wax component is 55° C.; and Table 3-3 (FIG. 9C) is a test result of the time when the melting point of the wax component is 102° C.

As shown in Table 3, it has been confirmed that a similar effect is obtained also in the case of the off-line coating, and that a similar effect is obtained also in the case where the melting point of the wax component has been changed.

<Test 4: Case where Paper Thickness and Paper Type have been Changed>

In order to confirm whether difference appears in the effect due to the difference in the paper thickness and the paper type, the same test as the basic test was conducted by using sheets of paper each having a different thickness and type of the paper to be used. (The test was conducted on the same condition as that in the basic test except for the paper thickness and paper type).

The paper which was used in the test is as follows.

(Paper A) Eye best W (trade name): made by Nippon Paper Industries Co., Ltd. (same paper as that in basic test)

Basis weight: 310 gsm (g/m$^2$)

Paper thickness: 0.34 mm (Paper B) NEW DV (trade name): made by Hokuetsu Kishu Paper Co., Ltd.

Basis weight: 310 gsm (g/m$^2$)

Paper thickness: 0.38 mm (Paper C) MARIKOTE (trade name): made by Hokuetsu Kishu Paper Co., Ltd.

Basis weight: 310 gsm (g/m$^2$)

Paper thickness: 0.38 mm (Paper D) Eye best W (trade name): made by Nippon Paper Industries Co., Ltd.

Basis weight: 210 gsm (g/m$^2$)

Paper thickness: 0.21 mm (Paper E) NEW DV (trade name): made by Hokuetsu Kishu Paper Co., Ltd.

Basis weight: 450 gsm (g/m$^2$)

Paper thickness: 0.55 mm (Paper F) OK TOPKOTE+ (trade name): made by Oji Paper Co., Ltd.

Basis weight: 127 gsm (g/m$^2$)

Paper thickness: 0.11 mm

In FIGS. 10A to 10F, Table 4-1 (FIG. 10A) is a test result of the paper A; Table 4-2 (FIG. 10B) is a test result of the paper B; Table 4-3 (FIG. 10C) is a test result of the paper C; Table 4-4 (FIG. 10D) is a test result of the paper D; Table 4-5 (FIG. 10E) is a test result of the paper E; and Table 4-6 (FIG. 10F) is a test result of the paper F.

As shown in Table 4, it has been confirmed that a similar effect can be obtained even when the paper thickness and the paper type have been changed.

<Test 5: Case where Amount of Ink has been Changed>

In order to confirm whether difference appears in the effect due to the difference of the amount of the ink or not, the same test as the basic test was conducted by using different amounts of ink. (The test was conducted on the same condition as that in the basic test except for the amount of the ink.)

The tested amounts of the ink are as follows.

(A) Amount of ink: 3.0 pL (same amount of ink as that in basic test)

(B) Amount of ink: 1.0 pL (C) Amount of ink: 5.0 pL

In FIGS. 11A to 11C, Table 5-1 (FIG. 11A) is a test result of the time when the ink amount is 3.0 pL; Table 5-2 (FIG. 11B) is a test result of the time when the ink amount is 1.0 pL; and Table 5-3 (FIG. 11C) is a test result of the time when the ink amount is 5.0 pL.

As shown in Table 5, it has been confirmed that a similar effect can be obtained even when the amount of the ink of an image which has been recorded on the paper has been changed.

<Test 6: Case of Surface Recording and Rear Face Recording>

In order to confirm whether difference appears in the effect depending on the surface recording or the rear face recording, or not, the same test as the basic test was conducted by the surface recording and the rear face recording.

Incidentally, the surface recording is the recording of the first image on unused paper. Accordingly, in addition to the case where the image is recorded only on one face of the paper, the case is included where the image is firstly recorded when the image is recorded on both faces of the paper. The rear face recording means the recording of the image onto the face in opposite side to the face having the image already recorded thereon, in the paper having the image already recorded on one face (recording of image on rear face side in the case where image is recorded on both faces of paper).

In FIGS. 12A and 12B, Table 6-1 (FIG. 12A) is a test result of the surface recording (same as basic test); and Table 6-2 (FIG. 12B) is a test result of the rear face recording.

As shown in Table 6, it has been confirmed that a similar effect can be obtained regardless of the surface recording and the rear face recording.

What is claimed is:

1. An image recording apparatus comprising:

an image recording unit that records an image on a medium by using an ink containing a wax component;

an ink drying unit that heats the surface of the image on the medium on which the image has been recorded by the image recording unit, and dries the ink;

a varnish application unit that applies an active ray-curing type of varnish onto the surface of the image on the medium on which the ink has been dried by the ink drying unit;

a varnish curing unit that irradiates the surface of the image on the medium on which the varnish has been applied by the varnish application unit, with active rays, and thereby cures the varnish;

a heating unit before a curing of the varnish, which heats the surface of the image on the medium, before the varnish that has been applied onto the surface of the image on the medium by the varnish application unit is cured by the varnish curing unit;

a unit of acquiring information on attained temperature when the ink has been dried, which acquires the information on the attained temperature T1 when the ink has been dried, when the attained temperature of the surface of the image on the medium when the ink has been dried by the ink drying unit is defined as the attained temperature T1 when the ink has been dried;

a melting point information acquiring unit which acquires information on a melting point TW of the wax component; and a control unit of heating before the curing of the varnish, which compares the attained temperature T1 when the ink has been dried with the melting point TW of the wax component, and when T1≥TW holds, makes the heating unit before the curing of the varnish operate and heat the surface of the image on the medium.

2. The image recording apparatus according to claim 1, wherein the control unit of heating before the curing of the varnish makes the heating unit before the curing of the varnish operate and heat the surface of the image on the medium to the melting point TW of the wax component or higher, when T1≥TW holds.

3. The image recording apparatus according to claim 1, wherein the unit of acquiring the information on the attained temperature when the ink has been dried measures a temperature of the surface of the image on the medium in the ink drying unit, and acquires the information on the attained temperature T1 when the ink has been dried.

4. The image recording apparatus according to claim 1, wherein the unit of acquiring the information on the attained temperature when the ink has been dried comprises:

a unit for acquiring a parameter for estimating the attained temperature when the ink has been dried, which acquires at least one information out of information on a thickness of the medium, information on a type of the medium, information on an amount of the ink to be given onto the medium, and information on a type of surface recording/rear face recording, as a parameter for estimating the attained temperature when the ink has been dried; and a unit for estimating the attained temperature when the ink has been dried, which estimates the attained temperature T1 when the ink has been dried, on the basis of the parameter for estimating the attained temperature when the ink has been dried, which is acquired by the unit for acquiring the parameter for estimating the attained temperature when the ink has been dried.

5. The image recording apparatus according to claim 4, wherein the unit for estimating the attained temperature when the ink has been dried has a table for estimating the attained temperature when the ink has been dried, in which a relationship between the parameter for estimating the attained temperature when the ink has been dried and the attained temperature T1 when the ink has been dried is specified, and estimates the attained temperature T1 when the ink has been dried, with reference to the table for estimating the attained temperature when the ink has been dried.

6. The image recording apparatus according to claim 1, wherein the image recording unit records the image onto the medium with an ink jet method.

7. A varnish application device that applies an active ray-curing type of varnish onto the surface of an image on a medium on which the image has been recorded with the use of an ink containing a wax component, then the surface of the image has been heated and the ink has been dried, comprising:

a varnish application unit which applies the varnish onto the surface of the image on the medium;

a varnish curing unit that irradiates the surface of the image on the medium on which the varnish has been applied by the varnish application unit, with active rays, and thereby cures the varnish;

a heating unit before a curing of the varnish, which heats the surface of the image on the medium, before the varnish that has been applied onto the surface of the image on the medium by the varnish application unit is cured by the varnish curing unit;

a unit of acquiring information on attained temperature when the ink has been dried, which acquires the information on the attained temperature T1 when the ink has been dried, when the attained temperature of the surface of the image on the medium when the ink has been dried is defined as the attained temperature T1 when the ink has been dried;

a melting point information acquiring unit which acquires information on a melting point TW of the wax component; and a control unit of heating before the curing of the varnish, which compares the attained temperature T1 when the ink has been dried with the melting point TW of the wax component, and when T1≥TW holds, makes the heating unit before the curing of the varnish operate and heat the surface of the image on the medium.

8. The varnish application device according to claim 7, wherein the control unit of heating before the curing of the varnish makes the heating unit before the curing of the varnish operate and heat the surface of the image on the medium to the melting point TW of the wax component or higher, when T1≥TW holds.

9. The varnish application device according to claim 7, wherein the unit of acquiring the information on the attained temperature when the ink has been dried comprises:

a unit for acquiring a parameter for estimating the attained temperature when the ink has been dried, which acquires at least one information out of information on a thickness of the medium, information on a type of the medium, information on an amount of the ink to be given onto the medium, and information on a type of surface recording/rear face recording, as a parameter for estimating the attained temperature when the ink has been dried; and a unit for estimating the attained temperature when the ink has been dried, which estimates the attained temperature T1 when the ink has been dried, on the basis of the parameter for estimating the attained temperature when the ink has been dried, which is acquired by the unit for acquiring the parameter for estimating the attained temperature when the ink has been dried.

10. The varnish application device according to claim 9, wherein the unit for estimating the attained temperature when the ink has been dried has a table for estimating the attained temperature when the ink has been dried, in which a relationship between the parameter for estimating the attained temperature when the ink has been dried and the attained temperature T1 when the ink has been dried is specified, and estimates the attained temperature T1 when the ink has been dried, with reference to the table for estimating the attained temperature when the ink has been dried.

11. An image recording method comprising:

an image recording step of recording an image on a medium with the use of an ink containing a wax component;

an ink drying step of heating the surface of the image on the medium on which the image has been recorded in the image recording step, and drying the ink;

a varnish application step of applying an active ray-curing type of varnish onto the surface of the image on the medium on which the ink has been dried in the ink drying step; and a varnish curing step of irradiating the surface of the image on the medium which has the varnish applied onto the surface of the image in the varnish application step, with active rays, and thereby curing the varnish, wherein the image recording method further comprises:

a determining step of comparing an attained temperature T1 when the ink has been dried with a melting point TW of the wax component, where an attained temperature of the surface of the image on the medium when the ink has been dried in the ink drying step is defined as the attained temperature T1 when the ink has been dried, and determining whether T1≥TW holds or not; and a heating step before a curing of the varnish, of heating the surface of the image on the medium before the varnish that has been applied onto the surface of the image on the medium in the varnish application step is cured in the varnish curing step, when T1≥TW holds.

12. The image recording method according to claim 11, wherein the heating step before the curing of the varnish is a step of heating the surface of the image on the medium to the melting point TW of the wax component or higher, when T1≥TW holds.

13. A varnish application method that applies an active ray-curing type of varnish onto the surface of an image on a medium on which the image has been recorded with the use of an ink containing a wax component, then the surface of the image has been heated and the ink has been dried, comprising:

a varnish application step of applying the varnish onto the surface of the image on the medium; and a varnish curing step of irradiating the surface of the image on the medium on which the varnish has been applied in the varnish application step, with active rays, and thereby curing the varnish, wherein the varnish application method further comprises:

a determining step of comparing an attained temperature T1 when the ink has been dried with a melting point TW of the wax component, where an attained temperature of the surface of the image on the medium when the ink has been dried is defined as the attained temperature T1 when the ink has been dried, and determining whether T1≥TW holds or not; and a heating step before a curing of the varnish, of heating the surface of the image on the medium before the varnish that has been applied onto the surface of the image on the medium in the varnish application step is cured in the varnish curing step, when T1≥TW holds.

14. The varnish application method according to claim 13, wherein the heating step before the curing of the varnish is a step of heating the surface of the image on the medium to the melting point TW of the wax component or higher, when T1≥TW holds.

* * * * *